US009349244B2

(12) United States Patent
Weingardt et al.

(10) Patent No.: US 9,349,244 B2
(45) Date of Patent: May 24, 2016

(54) DUAL MODE GAMING SYSTEM WITH BINGO PROGRESSIVE PLUG-IN

(71) Applicant: MPBINGO, LLC, Las Vegas, NV (US)

(72) Inventors: Gary Weingardt, Las Vegas, NV (US); Gary L. Loebig, Austin, TX (US); Gamin Weingardt, Las Vegas, NV (US); Jefferson Craig Lind, Austin, TX (US)

(73) Assignee: Gary Weingardt, Las Vegas, NV (US)

( * ) Notice: Subject to any disclaimer, the term of this patent is extended or adjusted under 35 U.S.C. 154(b) by 0 days.

(21) Appl. No.: 14/918,209

(22) Filed: Oct. 20, 2015

(65) Prior Publication Data

US 2016/0117884 A1 Apr. 28, 2016

Related U.S. Application Data

(60) Provisional application No. 62/068,550, filed on Oct. 24, 2014.

(51) Int. Cl.
*G07F 17/32* (2006.01)

(52) U.S. Cl.
CPC ..... *G07F 17/3223* (2013.01); *G07F 17/3258* (2013.01); *G07F 17/3272* (2013.01); *G07F 17/3286* (2013.01)

(58) Field of Classification Search
CPC ..... G07F 17/32
See application file for complete search history.

(56) References Cited

U.S. PATENT DOCUMENTS

2006/0142076 A1* 6/2006 Willyard ..... G07F 17/32 463/11
2012/0129587 A1* 5/2012 Nguyen ..... G07F 17/32 463/16
2013/0316785 A1* 11/2013 Lind ..... G07F 17/32 463/19
2013/0316789 A1* 11/2013 Warner ..... G07F 17/329 463/20

* cited by examiner

*Primary Examiner* — Omkar Deodhar
(74) *Attorney, Agent, or Firm* — Weiss & Moy, P.C.; Veronica-Adele R Cao

(57) ABSTRACT

A dual mode progressive bingo video gaming system that allows the switching between Class II and Class III gaming rules on a play by play basis and encourages play on the system by enhancing the player's experience with a bingo-based progressive jackpot integrated into games on the gaming system or that can be added as a separate plug-in module to virtually any base game regardless of classification.

73 Claims, 21 Drawing Sheets

| Far Miss Win Criteria | Prize (Example) |
|---|---|
| 0 spots marked in the game ending patter at the time the game ends | Mega Jackpot ($1,000,000) |
| Only 1 spot marked in the game ending pattern at the time the game ends | Super Jackpot ($100,000) |
| Only 2 spots marked in the game ending pattern at the time the game ends | Jackpot ($10,000) |
| Only 3 spots marked in the game ending pattern at the time the game ends | Mini-Jackpot ($100) |
| ... | ... |
| All spots marked in the game ending pattern at the time the game ends | Small Prize (Minimal prize to comply with regulations, typically $0.01 or a percentage of the wager.) |

FIG. 10

| Jackpot | Win Criteria | Growth | Win Probability | Average Jackpot Value |
|---|---|---|---|---|
| 1 | 0 Spots Marked in Game Ending Pattern | Primary = 0.04%<br>Reserve1 = 0.02%<br>Reserve2 = 0.02%<br>Reserve3 = 0.02%<br>Reserve4 = 0.02% | 5.00e-09<br>(1 win per 200 million plays) | $1,121,009.87<br>N/A<br>N/A<br>N/A<br>N/A |
| 2 | 1 Spot Marked in Game Ending Pattern | Primary = 0.04%<br>Reserve1 = 0.02%<br>Reserve2 = 0.02%<br>Reserve3 = 0.02%<br>Reserve4 = 0.02% | 5.33e-08<br>(1 win per 18.75 million plays) | $207,103.55<br>N/A<br>N/A<br>N/A<br>N/A |
| 3 | 2 Spots Marked in Game Ending Pattern | Primary = 0.04%<br>Reserve1 = 0.02%<br>Reserve2 = 0.02%<br>Reserve3 = 0.02%<br>Reserve4 = 0.02% | 8.18e-07<br>(1 win per 1.2 million plays) | $14,097.18<br>N/A<br>N/A<br>N/A<br>N/A |
| 4 | 3 Spots Marked in Game Ending Pattern | Primary = 0.04%<br>Reserve1 = 0.02%<br>Reserve2 = 0.02%<br>Reserve3 = 0.02%<br>Reserve4 = 0.02% | 6.37e-06<br>(1 win per 156,987.87 million plays) | $1,871.02<br>N/A<br>N/A<br>N/A<br>N/A |

FIG. 24

DUAL MODE GAMING SYSTEM WITH BINGO PROGRESSIVE PLUG-IN

CROSS-REFERENCE TO RELATED APPLICATIONS

The present patent application claims the benefit of U.S. Provisional Application No. 62/068,550, entitled "Dual Mode Gaming System with Bingo Progressive Plug-in," which was filed on Oct. 24, 2014 in the names of the inventors herein and which is incorporated herein by reference. This application is also related to U.S. Pat. No. 8,752,838, entitled "Video Bingo Game and Method Therefor," which was issued on Jun. 17, 2014 in the names of the inventors herein and which is incorporated herein by reference. This application is also related to U.S. patent application Ser. No. 14/066,117, entitled "Video Bingo Game and Method Therefor," which was filed on Oct. 29, 2013 in the names of the inventors herein and which is also incorporated herein by reference. This application is also related to U.S. patent application Ser. No. 14/257,870, entitled "Video Bingo Game and Method Therefor," which was filed on Apr. 21, 2014 in the names of the inventors herein and which is also incorporated herein by reference.

TECHNICAL FIELD

This invention relates generally to an electronic gaming system, and more particularly to an electronic bingo gaming system that allows the switching between Class II and Class III gaming rules on a play by play basis, and encourages play on the system by enhancing the player's experience with a bingo-based progressive jackpot integrated into games on the gaming system or that can be added as a separate plug-in module to virtually any base game regardless of classification.

BACKGROUND

According to the Indian Gaming and Regulatory Act (IGRA), Class II is defined as bingo and games similar to bingo and Class III is generally defined as casino-style gaming including games such as blackjack, poker, slot machines, craps, and roulette.

Computer networking technology has enabled Class II games to simulate many casino-style games including slot games by coordinating one or more multiplayer bingo games over a computer network to determine win and loss outcomes and map those outcomes to non-bingo displays.

As Native American gaming markets have developed, it has become common for a single gaming facility to offer a mix of Class II and Class III games.

In these mixed jurisdictions, there are advantages and disadvantages to both Class II and Class III gaming. Class III games have more diverse game libraries, but are taxed at a high rate relative to Class II games. Class II games may not be playable or may play at a slow rate if the number of active players on the network is low.

Mixed jurisdiction operators typically allocate a percentage of their available gaming space to Class II games and the remainder to Class III games. The balance between Class II and Class III is managed by the facility based on player traffic. Since Class II games require multiple players to play, the typical result is that Class II games receive less play than Class III games and only receive large amounts of play during high player traffic periods. To maximize earnings, it is desirable for facilities to maximize Class II game play. This balance between Class II and Class III is impossible to optimize manually.

One key to optimizing this balance is to encourage game play on Class II machines. Doing this requires innovative features and game formats. Since Class II gaming regulations require a multi-player bingo game to generate win and loss events, historically it has been difficult for game developers to implement skill-based games such as video poker while complying with accepted bingo rules.

In an attempt to address the need for video poker games in Class II markets, Weingardt et al. developed a unique bingo-based poker game called "Bingo Poker" based on a 52-spot bingo card and a 52-object bingo ball population (U.S. Pat. No. 8,752,838 and U.S Patent Application 20150119128). Using this combination, Weingardt et al. was able to create a bingo-based game that accurately models a traditional video poker game including the draw skill feature that is completely dependent on the bingo game's ball call. Unlike a traditional video poker game based on a 52-card deck and a fixed set of winning poker combinations, this bingo-based outcome generation system enables the implementation of large prizes tied to rare events that can occur because of the multiplayer nature of the bingo game. To increase excitement and provide players with previously unavailable and potentially life-changing jackpots on a video poker format, Weingardt et al. included far-miss jackpot prizes based on a player having very few or no spots marked on a pre-designated bingo pattern on their bingo card at the time the game is won by an opposing player.

The result is that one or more far-miss bingo prizes can be defined with multimillion dollar jackpot values. Although these far-miss bingo jackpots were originally designed as an integral component of the Bingo Poker game, one of the aspects of this invention is to attach this jackpot feature to games in addition to Bingo Poker.

The Dual Mode Progressive Bingo System (DMPB) described herein is designed to maximize earnings in conventional (land-based or floating) Class II and Class III gaming facilities and online gaming websites or combinations of Class II, Class III, and online gaming operations, both domestically and internationally—International regulations differ from country to country, e.g. in China, multi-player gaming is called C2C or Client 2 Client gaming. The DMPB maximizes earning potential by switching between Class II and Class III gaming rules on a play by play basis and encourages play on the system by enhancing the player's experience with a bingo-based progressive jackpot integrated into games on the DMPB system or that can be added as a separate plug-in module to virtually any base game regardless of classification.

The purpose of the Dual Mode Progressive Bingo System is to maximize earnings by maximizing the amount of time Class II games are operating on the gaming floor. The system accomplishes this by:

a. Encouraging players to choose DMPB gaming machines over non-DMPB gaming machines by offering a unique, bingo-based progressive that can be shared with games inside and outside of the facility, regardless of classification; and b. Operating as a Class II game during periods of high player usage and as a Class III game during periods of inadequate player participation.

The system consists of all of the components of a typical Class II electronic bingo system including bingo card distribution, a quorum building system, a ball call system, and database tables for recording game history and accounting information. In addition, the system includes a separate Class III database for recording activity that occurs when playing under Class III rules. Whether operating in Class II or Class III mode, the system uses a shared database for certain bingo functions and storing progressive information.

SUMMARY OF THE INVENTION

This summary is provided to introduce a selection of concepts of the present invention in a simplified form that are further described in detail below in the DETAILED DESCRIPTION OF THE INVENTION. This summary is not intended to identify each and every key feature of the invention, which remains the exclusive purview of claims, nor is the Summary intended to be used as an aid in determining the scope of the claimed subject matter.

In accordance with one embodiment of the present invention, a dual mode progressive bingo video gaming system is disclosed. The dual mode progressive bingo video gaming system comprises: a plurality of gaming terminals connected to the dual mode progressive bingo video gaming system; a database to record activity on games played on the dual mode progressive bingo video gaming system under Class II gaming rules; a database to record activity on games played on the dual mode progressive bingo video gaming system under Class III gaming rules; a shared database for storing progressive information for all games played on the dual mode progressive bingo video gaming system under Class II gaming rules and under Class III gaming rules; a progressive database to connect to an independent Class II gaming system and an independent Class III gaming system so that a progressive jackpot may be shared among all of the games being played on the dual mode progressive video gaming system, the independent Class II gaming system, and the independent Class III gaming system; and a dual mode gaming system comprising: a switching logic to switch automatically between Class II gaming rules and Class III gaming rules on a play by play basis based on availability of players to create a quorum; a bingo progressive module for adding bingo-based far-miss progressive jackpots to any game played on the dual mode progressive bingo video gaming system, the bingo progressive module having a ball call system, a quorum builder, and a bingo card distribution system; a virtual bingo card that is played by the dual mode gaming system when a game is being played under Class III gaming rules; a processor for executing program instructions and a memory coupled to the processor for storing program instructions, the programming instructions comprising: receiving at least one play request from at least one player; continuously monitoring whether another play request is received from at least another player; determining whether a quorum of players is established within a predetermined period of time; initiating a bingo game under one of Class II gaming rules and Class III gaming rules for the at least one player depending upon whether the quorum of players is established within the predetermined period of time; and ending the bingo game when a bingo card of a player has achieved a predetermined game ending pattern.

In accordance with another embodiment of the present invention, a dual mode progressive bingo video gaming system is disclosed. The dual mode progressive bingo video gaming system comprises: a plurality of gaming terminals connected to the dual mode progressive bingo video gaming system; a database to record activity on games played on the dual mode progressive bingo video gaming system under Class II gaming rules; a database to record activity on games played on the dual mode progressive bingo video gaming system under Class III gaming rules; a shared database for storing progressive information for all games played on the dual mode progressive bingo video gaming system under Class II gaming rules and under Class III gaming rules; and a dual mode gaming system comprising: a switching logic to switch automatically between Class II gaming rules and Class III gaming rules on a play by play basis based on availability of players to create a quorum; a bingo progressive module for adding bingo-based far-miss progressive jackpots to any game played on the dual mode progressive bingo video gaming system, the bingo progressive module having a ball call system, a quorum builder, and a bingo card distribution system; a virtual bingo card that is played by the dual mode gaming system when a game is being played under Class III gaming rules; a processor for executing program instructions and a memory coupled to the processor for storing program instructions, the programming instructions comprising: receiving at least one play request from at least one player; continuously monitoring whether another play request is received from at least another player; determining whether a quorum of players is established within a predetermined period of time; initiating a bingo game under one of Class II gaming rules and Class III gaming rules for the at least one player depending upon whether the quorum of players is established within the predetermined period of time; and ending the bingo game when a bingo card of a player has achieved a predetermined game ending pattern.

In accordance with another embodiment of the present invention, a dual mode progressive bingo video gaming system is disclosed. The dual mode progressive bingo video gaming system comprises: a plurality of gaming terminals connected to the dual mode progressive bingo video gaming system; a database to record activity on games played on the dual mode progressive bingo video gaming system under Class II gaming rules; a database to record activity on games played on the dual mode progressive bingo video gaming system under Class III gaming rules; a shared database for storing progressive information for all games played on the dual mode progressive bingo video gaming system under Class II gaming rules and under Class III gaming rules; and a dual mode gaming system comprising: a switching logic to switch automatically between Class II gaming rules and Class III gaming rules on a play by play basis based on availability of players to create a quorum; a bingo progressive module for adding bingo-based far-miss progressive jackpots to any game played on the dual mode progressive bingo video gaming system, the bingo progressive module having a ball call system, a quorum builder, and a bingo card distribution system; a virtual bingo card that is played by the dual mode gaming system when a game is being played under Class III gaming rules; a processor for executing program instructions and a memory coupled to the processor for storing program instructions, the programming instructions comprising: receiving at least one play request from at least one player; continuously monitoring whether another play request is received from at least another player; determining whether a quorum of players is established within a predetermined period of time; initiating a multiplayer bingo game under Class II gaming rules when a quorum of players is established within the predetermined period of time; initiating a single player bingo game under Class III gaming rules when a quorum of players is not established within the pre-determined period of time; and ending one of the multiplayer bingo game and the single player bingo game when a bingo card of a player has achieved a predetermined game ending pattern.

In accordance with another embodiment of the present invention, a dual mode bingo video gaming system is disclosed. The dual mode bingo video gaming system comprises: a plurality of gaming terminals connected to the dual mode bingo video gaming system; a database to record activity on games played on the dual mode bingo video gaming system under Class II gaming rules; a database to record activity on games played on the dual mode bingo video gaming system under Class III gaming rules; a dual mode gaming system comprising: a switching logic to switch automatically between Class II gaming rules and Class III gaming rules on a play by play basis based on availability of players to create a quorum; a ball call system; a quorum builder; a bingo card distribution system; a virtual bingo card that is played by the dual mode gaming system when a game is being played under Class III gaming rules; a processor for executing program instructions and a memory coupled to the processor for storing program instructions, the programming instructions comprising: receiving at least one play request from at least one player; continuously monitoring whether another play request is received from at least another player; determining whether a quorum of players is established within a predetermined period of time; initiating a bingo game under one of Class II gaming rules and Class III gaming rules for the at least one player depending upon whether the quorum of players is established within the predetermined period of time; and ending the bingo game when a bingo card of a player has achieved a predetermined game ending pattern.

In accordance with another embodiment of the present invention, a bingo progressive video gaming system adapted to be used as a bonusing mechanism with an independent Class III game is disclosed. The bingo progressive video gaming system adapted to be used as a bonusing mechanism with an independent Class III game comprises: a plurality of independent Class gaming terminals connected to the bingo progressive video gaming system; a database to record activity on games played on the bingo progressive video gaming system under Class III gaming rules; a progressive database; a ball call system; a bingo card distribution system; a progressive prize distribution system; a virtual bingo card; and a processor for executing program instructions and a memory coupled to the processor for storing program instructions, the programming instructions comprising: receiving a play request from one player; initiating a base game on one of the Class III gaming terminals; initiating a bingo progressive side-game under Class III gaming rules for the player; and ending the bingo game when one of the bingo card of the player and the virtual bingo card has achieved a predetermined game ending pattern.

In accordance with another embodiment of the present invention, a dual mode progressive bingo video gaming system is disclosed. The dual mode progressive bingo video gaming system comprises: a plurality of gaming terminals connected to the dual mode progressive bingo video gaming system; a database to record activity on games played on the dual mode progressive bingo video gaming system under Class II gaming rules; a database to record activity on games played on the dual mode progressive bingo video gaming system under Class III gaming rules; a Class II bingo and progressive database for storing bingo game and progressive information for all games played on the dual mode progressive bingo video gaming system under Class II gaming rules; a Class III bingo and progressive database for storing bingo game and progressive information for all games played on the dual mode progressive bingo video gaming system under Class III gaming rules; and a dual mode gaming system comprising: a switching logic to switch automatically between Class II gaming rules and Class III gaming rules on a play by play basis based on availability of players to create a quorum; a bingo progressive module for adding bingo-based far-miss progressive jackpots to any game played on the dual mode progressive bingo video gaming system, the bingo progressive module having a ball call system, a quorum builder, and a bingo card distribution system; a virtual bingo card that is played by the dual mode gaming system when a game is being played under Class III gaming rules; a processor for executing program instructions and a memory coupled to the processor for storing program instructions, the programming instructions comprising: receiving at least one play request from at least one player; continuously monitoring whether another play request is received from at least another player; determining whether a quorum of players is established within a predetermined period of time; initiating a bingo game under one of Class II gaming rules and Class III gaming rules for the at least one player depending upon whether the quorum of players is established within the predetermined period of time; and ending the bingo game when a bingo card of a player has achieved a predetermined game ending pattern.

In accordance with another embodiment of the present invention, a dual mode progressive bingo video gaming system is disclosed. The dual mode progressive bingo video gaming system comprises: a plurality of gaming terminals connected to the dual mode progressive bingo video gaming system; a database to record activity on games played on the dual mode progressive bingo video gaming system under Class II gaming rules; a database to record activity on games played on the dual mode progressive bingo video gaming system under Class III gaming rules; a Class II bingo database for storing bingo game information for all games played on the dual mode progressive bingo video gaming system under Class II gaming rules; a Class III bingo database for storing bingo game information for all games played on the dual mode progressive bingo video gaming system under Class III gaming rules; a Class II progressive database for storing progressive prize information for all games played on the dual mode progressive bingo video gaming system under Class II gaming rules; a Class III progressive database for storing progressive prize information for all games played on the dual mode progressive bingo video gaming system under Class III gaming rules; and a dual mode gaming system comprising: a switching logic to switch automatically between Class II gaming rules and Class III gaming rules on a play by play basis based on availability of players to create a quorum; a bingo progressive module for adding bingo-based far-miss progressive jackpots to any game played on the dual mode progressive bingo video gaming system, the bingo progressive module having a ball call system, a quorum builder, and a bingo card distribution system; a virtual bingo card that is played by the dual mode gaming system when a game is being played under Class III gaming rules; a processor for executing program instructions and a memory coupled to the processor for storing program instructions, the programming instructions comprising: receiving at least one play request from at least one player; continuously monitoring whether another play request is received from at least another player; determining whether a quorum of players is established within a predetermined period of time; initiating a bingo game under one of Class II gaming rules and Class III gaming rules for the at least one player depending upon whether the quorum of players is established within the predetermined period of time; and ending the bingo game when a bingo card of a player has achieved a predetermined game ending pattern.

BRIEF DESCRIPTION OF THE DRAWINGS

Embodiments of the disclosure will become more fully understood from the detailed description and the accompanying drawings, wherein:

FIG. 10 is a table of exemplary far-miss win criteria with sample jackpots, according to one or more aspects of the present invention;

FIG. 24 is a table showing exemplary probabilities and sample jackpot amounts for far-miss bingo progressives, according to one or more aspects of the present invention.

DETAILED DESCRIPTION OF THE INVENTION

Figure 1:
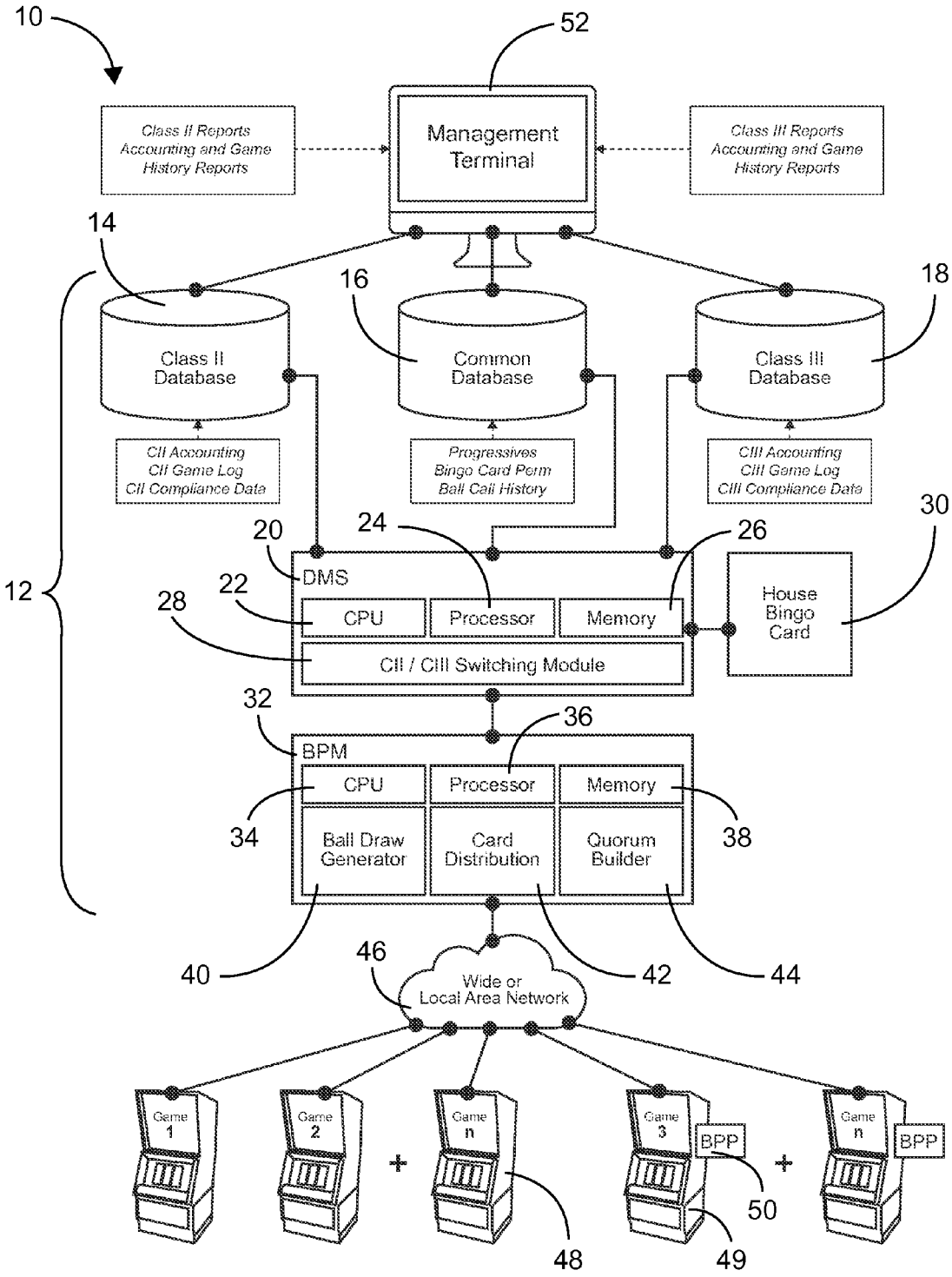
FIG. 1 is an exemplary dual mode progressive bingo system components diagram, according to one or more aspects of the present invention.

The description set forth below in connection with the appended drawings is intended as a detailed description of presently known exemplary embodiments of the disclosure and is not intended to represent the only forms in which the present invention can, may, or could be constructed and/or utilized. The detailed description sets forth the functions and the sequence of the steps for constructing and operating the disclosure in connection with the illustrated embodiments as well as the best mode of carrying out the invention. It is to be understood, however, that the same or equivalent functions and sequences can be accomplished by different exemplary embodiments that are also intended to be encompassed within the spirit and scope of this invention.

The following definitions may be used herein. Dual Mode Gaming (DMG) refers to the capability of the DMPB 10 to switch between Class II and Class III rules on a play by play basis. The Dual Mode Progressive Bingo System (DMPB) 10 is a combination of software components that facilitates Dual Mode Gaming. The DMPB 10 includes the Bingo Progressive Module (BPM) 32 and all of its components. The Bingo Progressive Module 32 refers to the collection of components that provide bingo based progressive jackpots to bingo and non-bingo based games. This module 32 enhances the DMPB 10 to encourage game play. Bingo Progressive Plug-in (BPP) 50 refers to the component of the Bingo Progressive Module 32 that can be added to any game to provide players an opportunity to win progressive jackpots offered by the BPM 32.

The preferred embodiment of the Dual Mode Progressive Bingo System (DMPB) 10 depicted in FIG. 1 consists of all of the components of a typical Class II electronic bingo system (such as the Bingo Progressive Module 32 described below) including a CPU 34, processor 36 and memory 38 executing software applications providing a bingo card distribution system 42, a quorum building system 44, a ball call system 40, and database tables 14, 16 for recording game history and accounting information. The system also includes a separate Class III database 18 for recording activity that occurs when playing under Class III rules and a house bingo card 30 to be used in lieu of a second player when playing as a Class III game. The DMPB 10 uniquely combines these systems into a single combined Class II and Class III system by using the Switching System 20 consisting of a CPU 22, processor 24 and memory 26 executing a real time switching software algorithm 28. Whether operating in Class II or Class III mode, the DMPB system 10 uses a shared database 16 for certain bingo functions and storing progressive information. Gaming terminals 48 connect to the DMPB system 10 through a wide or local area network 46 using standard networking technologies. Gaming terminals 48 may connect to the DMPB system 10 by either natively supporting the bingo game as an element of the game software or using the Bingo Progressive Plug-in 50. Non-dual mode compatible gaming terminals 49, terminals not capable of switching between Class II and Class III rules, may participate in the bingo progressive game only by leveraging a Bingo Progressive Plug-in (BPP) 50 to expand player participation.

Managing the system is accomplished by using a single management terminal 52 computer that can generate reports from any of the databases 14, 16, 18 to comply with Class II and Class III regulations. However, it should be clearly understood that substantial benefit may be derived from the use of more than one management terminal 52 computer.

Two technologies are required to make the DMPB 10 viable: 1) the Dual Mode Switching (DMS) system 20—wherein the software algorithm/logic 28 provides the ability to switch on a play by play basis between Class II and Class III gaming rules; and 2) the Bingo Progressive Module (BPM) 32—which provides a game enhancing feature that expands participation to enable very large prizes, thus attracting enough player participation to ensure adequate play to facilitate optimized earnings. Together the DMS 20 and the BPM 32 and their associated hardware and databases combine to make the core Dual Mode Gaming (DMG) system 12 components of the DMPB 10.

Figure 1A:
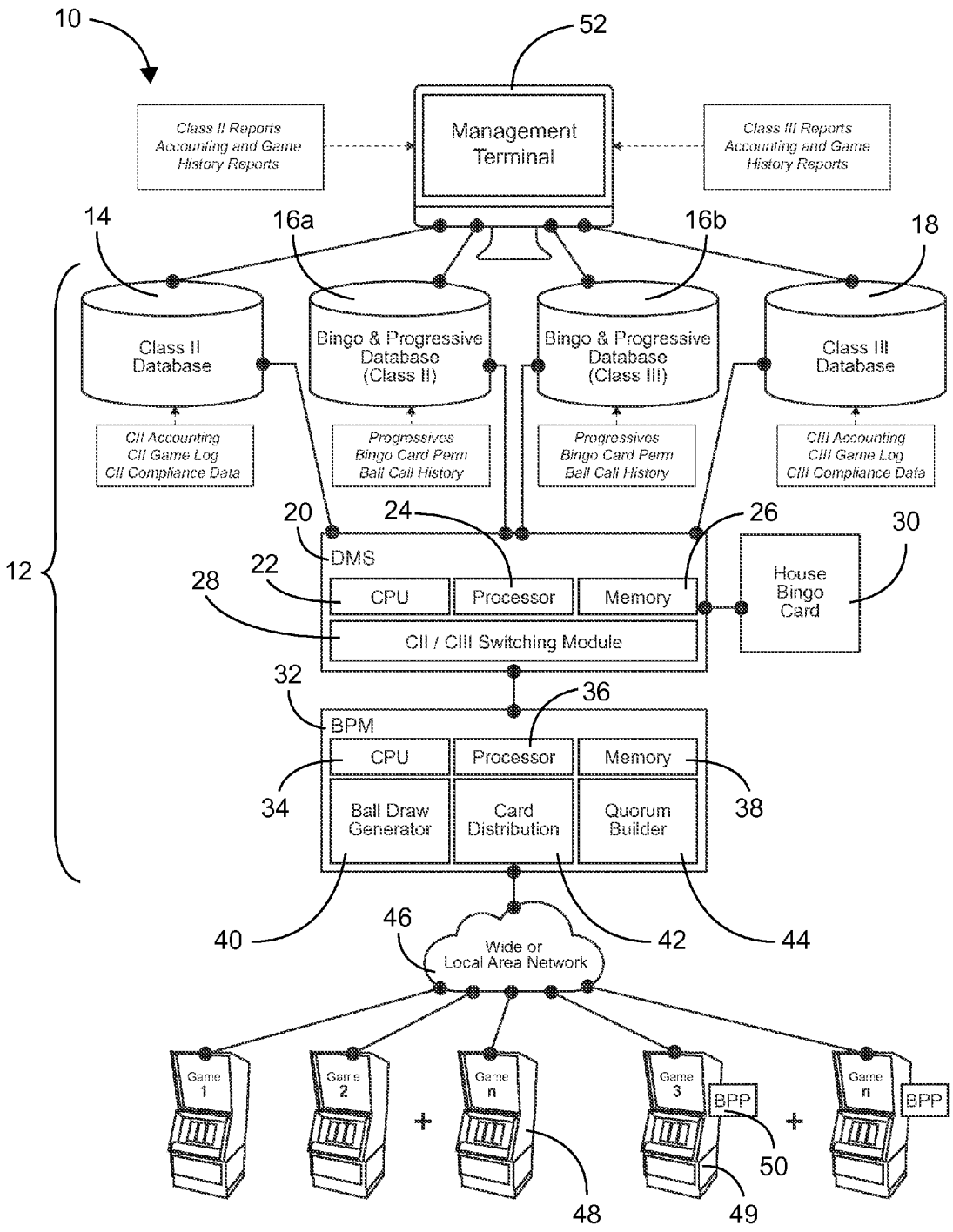
FIG. 1*a* is an exemplary dual mode progressive bingo system components diagram with separate progressive databases for Class II and Class III functions, according to one or more aspects of the present invention.

FIG. 1*a* is an alternate embodiment of the same system as FIG. 1 where the Common Database 16 of FIG. 1 has been divided into a Class II Bingo and Progressive Database 16*a* and a Class III Bingo and Progressive Database 16*b*. This embodiment serves jurisdictions where Class II and Class III systems may not share progressive prizes. Thus the Class II Bingo and Progressive Database 16*a* stores its own game play history, bingo card perm, ball call history, and progressive prize values. Similarly the Class III Bingo and Progressive Database 16*b* stores its own game play history, bingo card perm, ball call history, and progressive prize values. When operating as a Class II gaming system, players are eligible only for the progressive prize values stored in the Class II Bingo and Progressive Database 16*a*. When operating as a Class III gaming system, players are eligible only for the progressive prize values stored in the Class III Bingo and Progressive Database 16*b*. In this embodiment, player terminals 48 and player terminals 49 utilizing the BPP 50 will display the appropriate progressive prizes from the Class II Bingo and Progressive Database 16*a* or Class III Bingo and Progressive Database 16*b* depending on the ability of the BPM 32 to build a quorum or not as directed by the DMS 20.

Dual Mode Switching System

The Dual Mode Switching (DMS) system 20 provides the DMPB 10 with the capability of switching automatically between Class II and Class III game play based on the availability of additional players to create quorums. A quorum is the minimum number of players required to play the bingo game.

All DMG system 12 game play includes bingo based outcome determination as is standard in existing Class II gaming, however, the differentiation between a Class II and a Class III game is determined by the availability of multiple players. Therefore, the DMG system 12 ideally plays most or all games in Class II mode to avoid Class III gaming fees.

Figure 2:
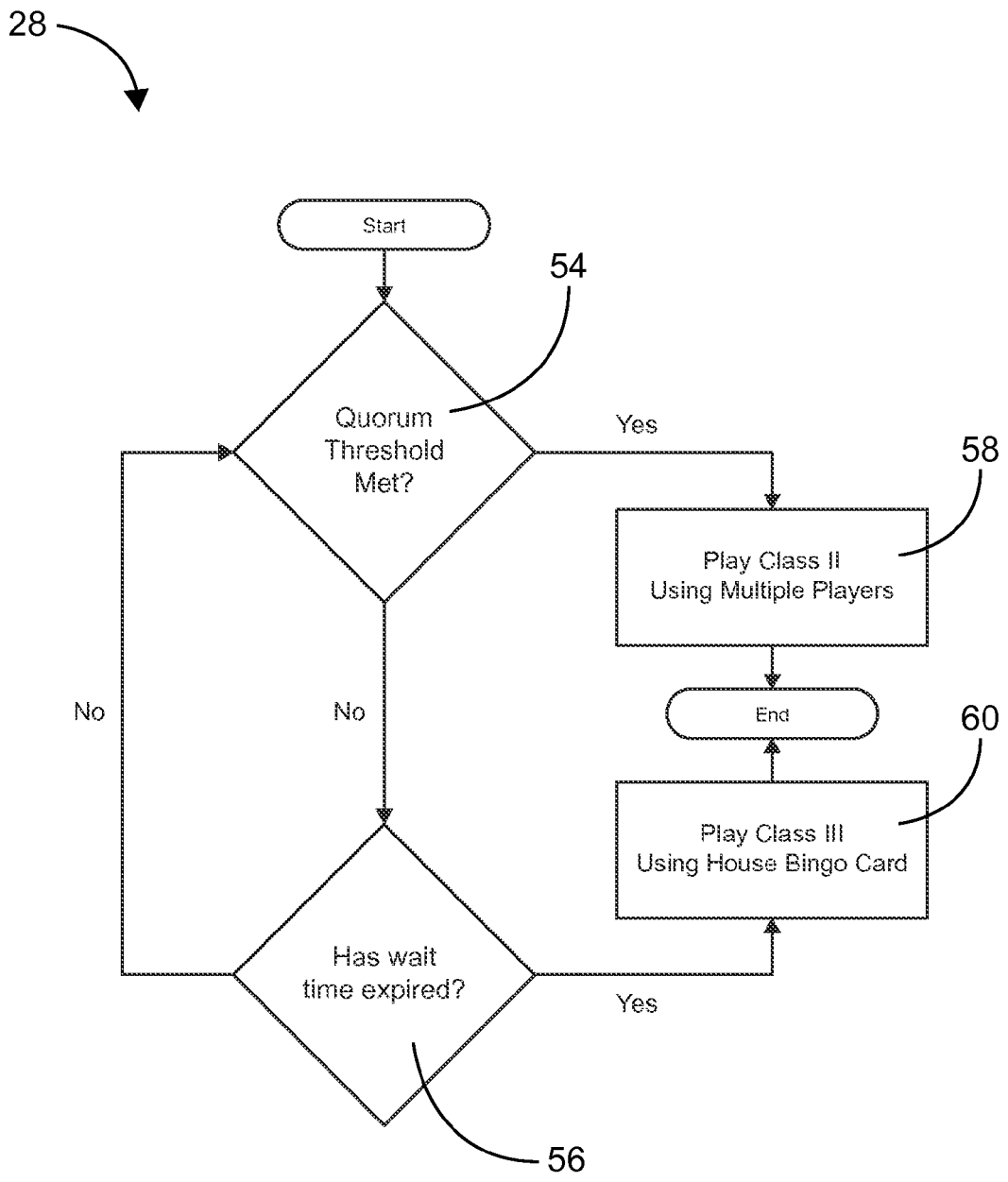
FIG. 2 is a switching logic flow chart according to one or more aspects of the present invention.

Referring to FIG. 2, to determine whether to play a game in Class II or Class III modes, the DMS system's 20 switching logic 28 always attempts to pair each game request with a quorum of players by continuously monitoring play requests that are received from any players. The switching software algorithm/logic 28 leverages inputs including the number of play requests collected, the amount of time that has passed since the first play request was collected, configurable settings such as the maximum amount of time to wait before proceeding with either a Class II or Class III game, environmental information such as the time of day, and historical statistical data such as average traffic at a given time of day or day of the week. The algorithm/logic 28 can be as simple as a configurable amount of time (typically 1 second or less from the time the "play" button is pushed) and quorum size or it may be based on many factors as described above. If a quorum of players is available (at step 54), a multiplayer bingo game under the rules of Class II gaming is executed (at step 58) to determine whether or not the player wins a prize. If a quorum of players is not available during the configured time period (at step 56), the machine plays a single player bingo game under the rules of Class III gaming (at step 60) instead of refunding the player's wager as typically occurs in Class II gaming when quorum sizes aren't met within a specified amount of time. Regardless of whether the machine/player terminal 48 plays a Class II multiplayer bingo game or a Class III single player bingo game, the same winning conditions will pay the same prizes with the same game play experience. The bingo game may typically be mapped to a reel spin or other common gaming display.

The advantage of the DMG system 12 is that operators are able to avoid high taxes charged under Class III agreements for any play that can be executed under Class II rules. The effective result is that the gaming floor operates as Class II during high traffic time periods and Class III during low traffic time periods while keeping the player's experience exactly the same.

The key to the DMG system 12 is an accounting and logging system of the databases 14, 16, 18 (see FIG. 1) that can meet the regulations of both Class II and Class III markets. To do this, any play with a quorum of players will be logged in dedicated Class II accounting tables of database 14. Any play with only one player (wherein the second player is a virtual card played by the operator) will be logged in dedicated Class III tables of database 18.

Figure 3:
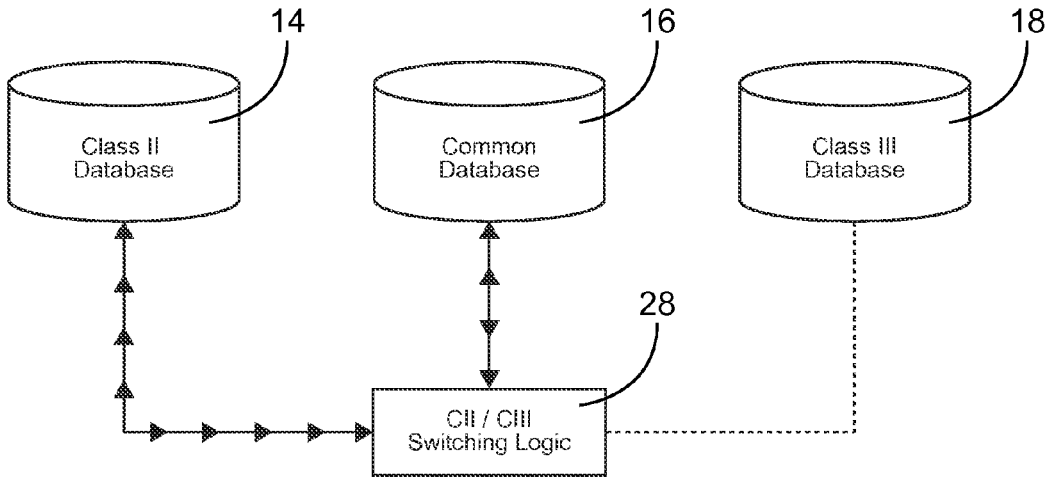
FIG. 3 is a diagram of dual mode progressive bingo Class II database communications.
Figure 4:
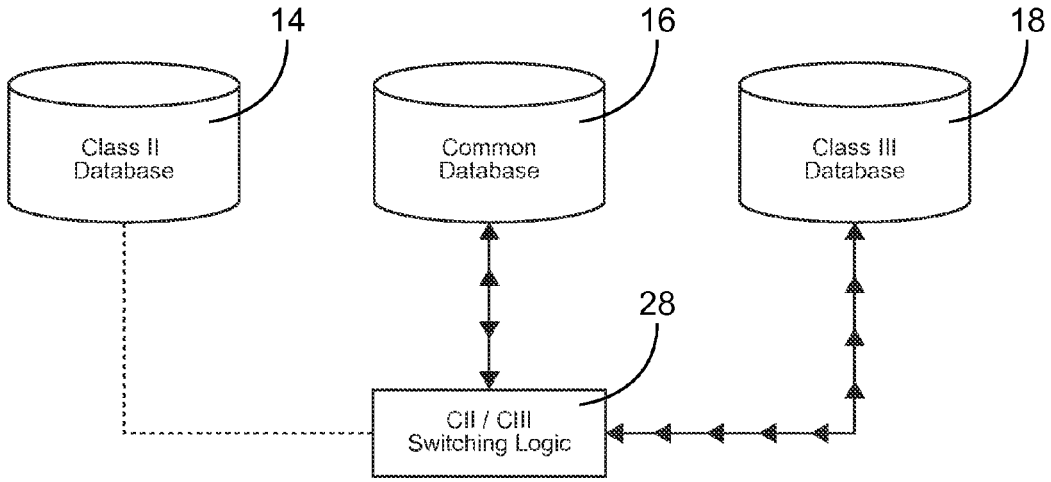
FIG. 4 is a diagram of dual mode progressive bingo Class III database communications.

The result is that the DMG system 12 can account for all games played with a set of Class II reports and logs and a separate set of Class III reports and logs as illustrated previously in FIG. 1. Signal routing to these databases 14, 16, 18 is illustrated in FIG. 3 (showing Class II) and FIG. 4 (showing Class III). If the DMS system's 20 switching logic 28 determines that a quorum exists to play a game by Class II rules, data is stored to and retrieved from the Class II Database 14 and logging information is stored in the Common Database 16. If the DMS system's 20 switching logic 28 determines that no quorum exists, data is stored to and retrieved from the Class III Database 18 and logging information is stored in the Common Database 16.

Figure 5:
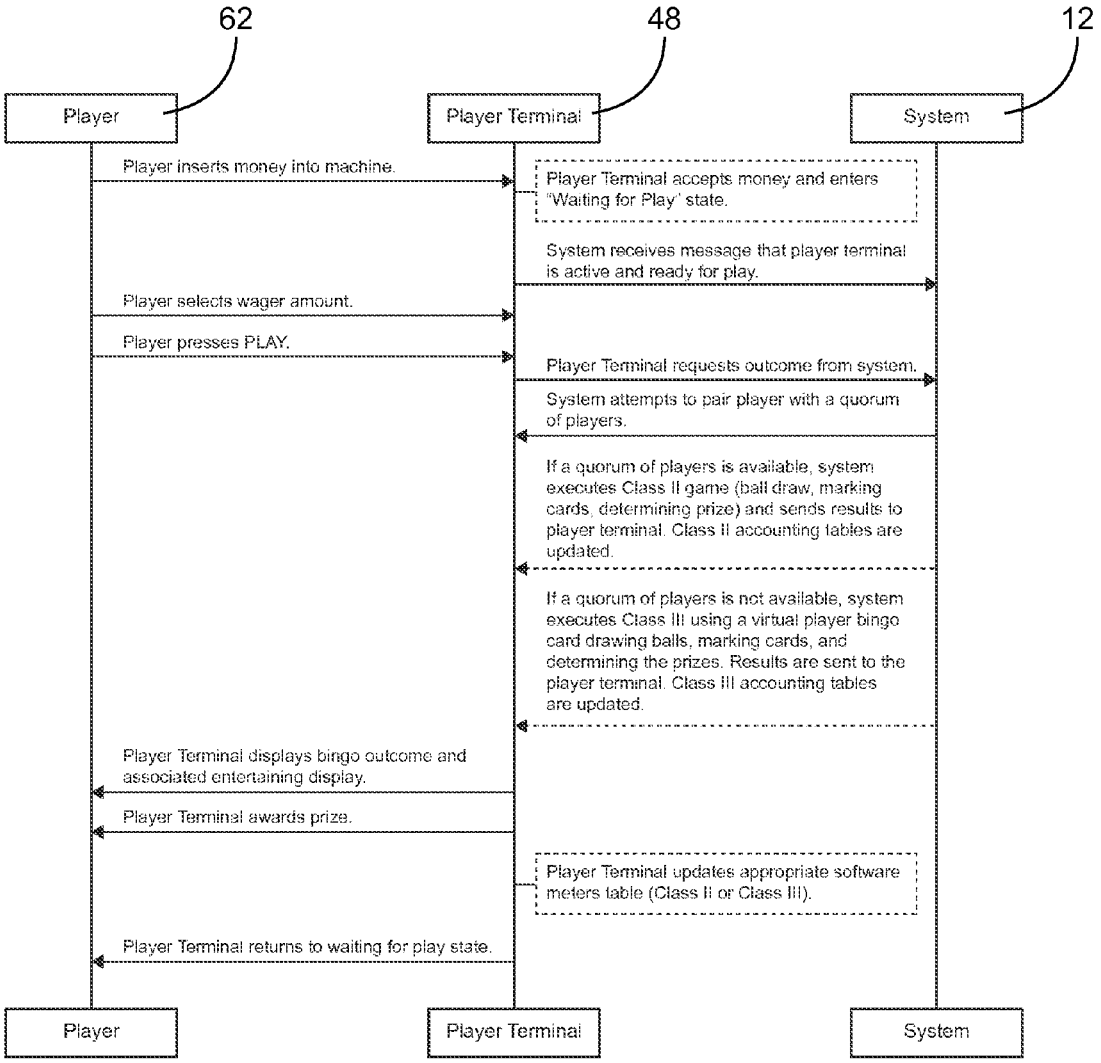
FIG. 5 is a diagram of exemplary dual mode player, player terminal, and system communications, according to one or more aspects of the present invention.

Thus, dual mode game play is a sequence of automated decisions by the DMG system 12 software as illustrated in the game play sequence of FIG. 5 where the Player 62 initiates play on the Player Terminal 48, 49 which sends a request to the DMG System 12 to participate in a bingo game. The DMG System 12 attempts to collect additional players into a quorum. If a quorum exists, the DMG System 12 responds to the Player Terminal 48, 49 with Class II game play data. If not, the DMG System 12 responds to the Player Terminal 48, 49 with Class III game play data. The Player Terminal 48, 49 displays the outcome, Class II or Class III, appropriately to the Player 62.

Except for an instruction from the DMG system 12 regarding updating of the proper accounting meters (Class II or Class III) on the machine/player terminal 48, 49, the machine/player terminal 48, 49 behaves exactly the same regardless of whether the game is played as Class II or Class III.

Bingo Progressive Module

Figure 6:
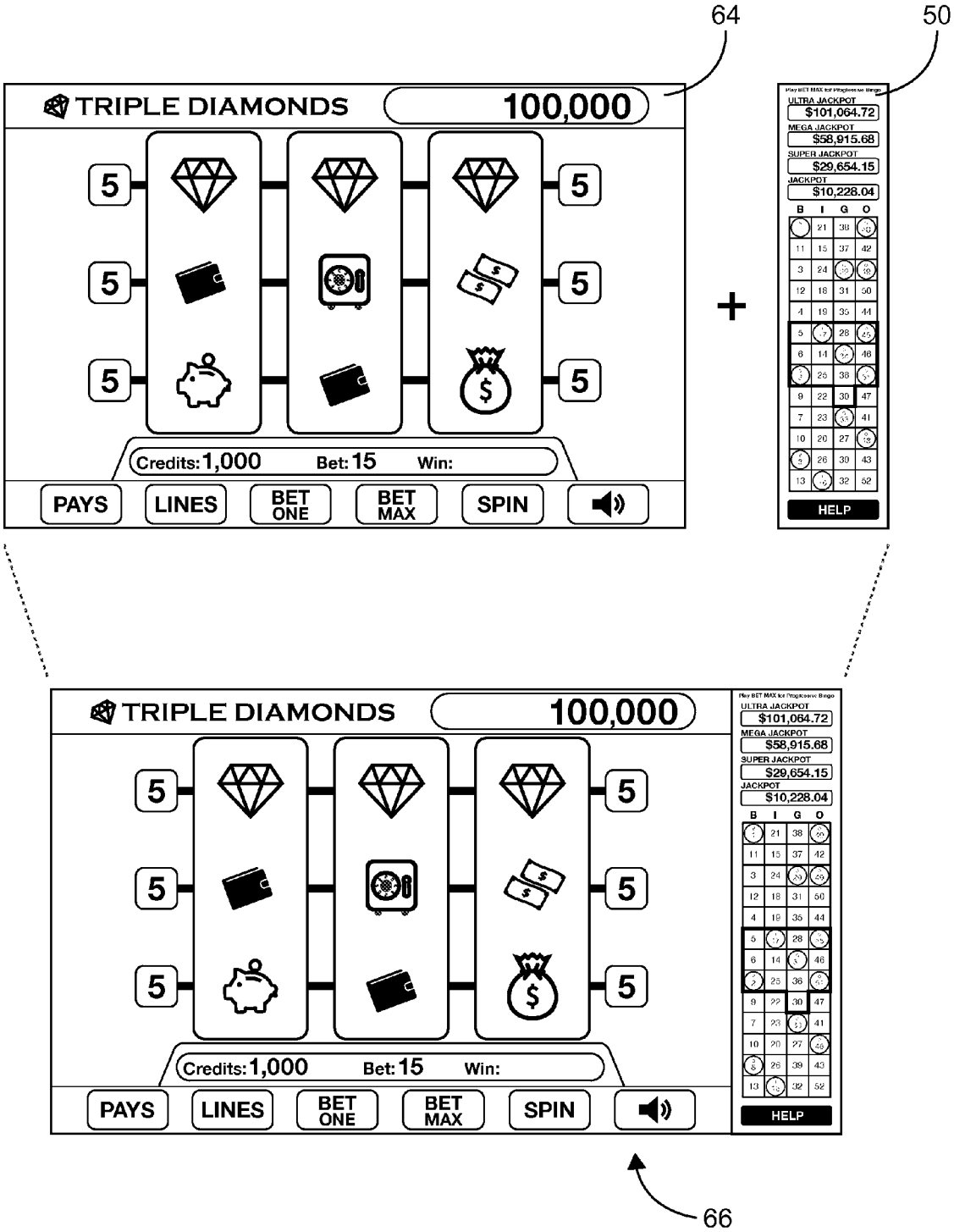
FIG. 6 is an exemplary bingo progressive plug-in game screen, according to one or more aspects of the present invention.

The Bingo Progressive Module (BPM) 32 is an integrated component of the DMPB 10 to encourage player participation by offering life changing jackpots that can be added to non-DMPB games through a plug in software module. The BPM 32 consists of a combination of server software components and a player interface called the Bingo Progressive Plug-in (BPP) 50 that can be added to any online game or physical gaming machine to provide large progressives to virtually any base game. These progressives share the BPM 32 outcome generation engine components (ball call 40, card distribution 42, and quorum builder 44), the system for playing bingo to determine winners, with the DMG system 12 which is also used by the innovative Bingo Poker game(s) designed and patented by Weingardt et al. FIG. 6 depicts the addition of the BPP interface 50 to a Class III non-bingo base game 64 creating the combination game screen 66. The result is a non-bingo base game with bingo progressive side game.

The purpose of the Bingo Progressive Module 32 is to increase the number of and types of gaming devices that can participate in the progressive jackpots associated with Bingo Poker. In a preferred embodiment, the Class II and Class III games would share the same jackpot(s). The BPM 32 is an important and fully integrated component of the DMPB 10. That being said, the BPM 32 can work independently of the DMPB 10 as well by adding the BPP 50 to any compatible Class II or Class III gaming machine, allowing participation in one or more of the large progressive jackpots offered by the DMPB 10.

Like Bingo Poker, the BPM 32 progressives are won using a far-miss progressive jackpot criterion and are dependent on a second bingo card in the game to determine the winner. In Bingo Poker (described in U.S. Pat. No. 8,752,838), the far-miss progressives may be awarded to a player with no or with a few spots marked in the game ending pattern at the time the game ends due to another player's bingo card achieving the game ending pattern in the same game. In another embodiment (described in U.S. patent application Ser. No. 14/066,117), where a player may play multiple bingo cards at time, the player may be able to win both the game ending pattern and the far-miss progressive. Each qualifying play (some base game bet levels may be excluded from eligibility to win the BPM Progressives) involves the player's bingo card and at least one additional bingo card in play by the same player, by another player or, in the case of the Class III implementation, in play by the house.

Figure 7:
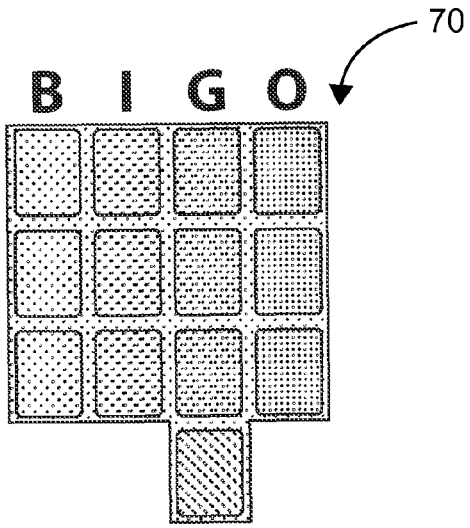
FIG. 7 is an exemplary bingo progressive module 13-spot BIGO card, according to one or more aspects of the present invention.
Figure 8:
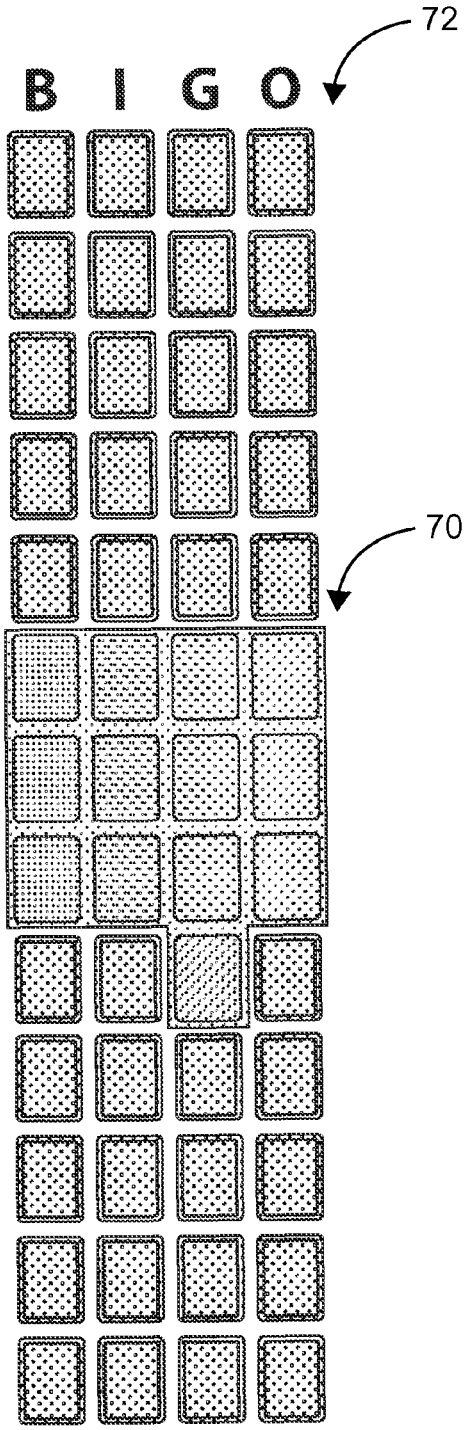
FIG. 8 is an exemplary bingo progressive module 52-spot flashboard style 13-spot BIGO card, according to one or more aspects of the present invention.

Although the BPM 32 can be designed using a wide variety of game ending bingo patterns and total balls in a random ball population, the initial implementation of the BPM 32 uses a 52-ball population, a 52-space flashboard 72, and a randomly generated 12-spot plus 1 bingo card 70 (FIG. 8). Each space on the flashboard 72 is intended to correspond to a particular numbered ball used in the bingo game with the total number of spaces on the flashboard 72 corresponding to the total number of numbered balls used. In one embodiment, there may be 52 spaces on the flashboard 72 to correspond to 52 balls that are numbered consecutively with numbers 1-52. It should be clearly understood, however, that it is possible to vary the number of spaces on the flashboard 72 and the number of balls, and it would also be possible to provide a non-corresponding number of spaces on the flashboard 72 to balls. FIG. 7 depicts the 13-spot bingo card 70 (labeled BIGO because of the use of only 4 columns). As shown, the bingo card 70 is divided into 3 columns of 3 rows and 1 column of 3 rows plus 1 spot. Column 1 is labeled "B" and contains 3 numbers randomly selected between 1 and 13 where one number is placed in each row. In a similar fashion, Column 2 is labeled "I" using numbers between 14 and 26 that are randomly selected; Column 3 consists of 4 rows and is labeled "G" using 4 numbers between 27 and 39 that are randomly selected; and column 4 consists of 3 rows labeled "O" with numbers from between 40 and 52 that are randomly selected. FIG. 8 depicts the same 13-spot bingo card 70 of FIG. 7 in an alternate display as a component of the bingo (BIGO) flashboard 72.

Figure 9:
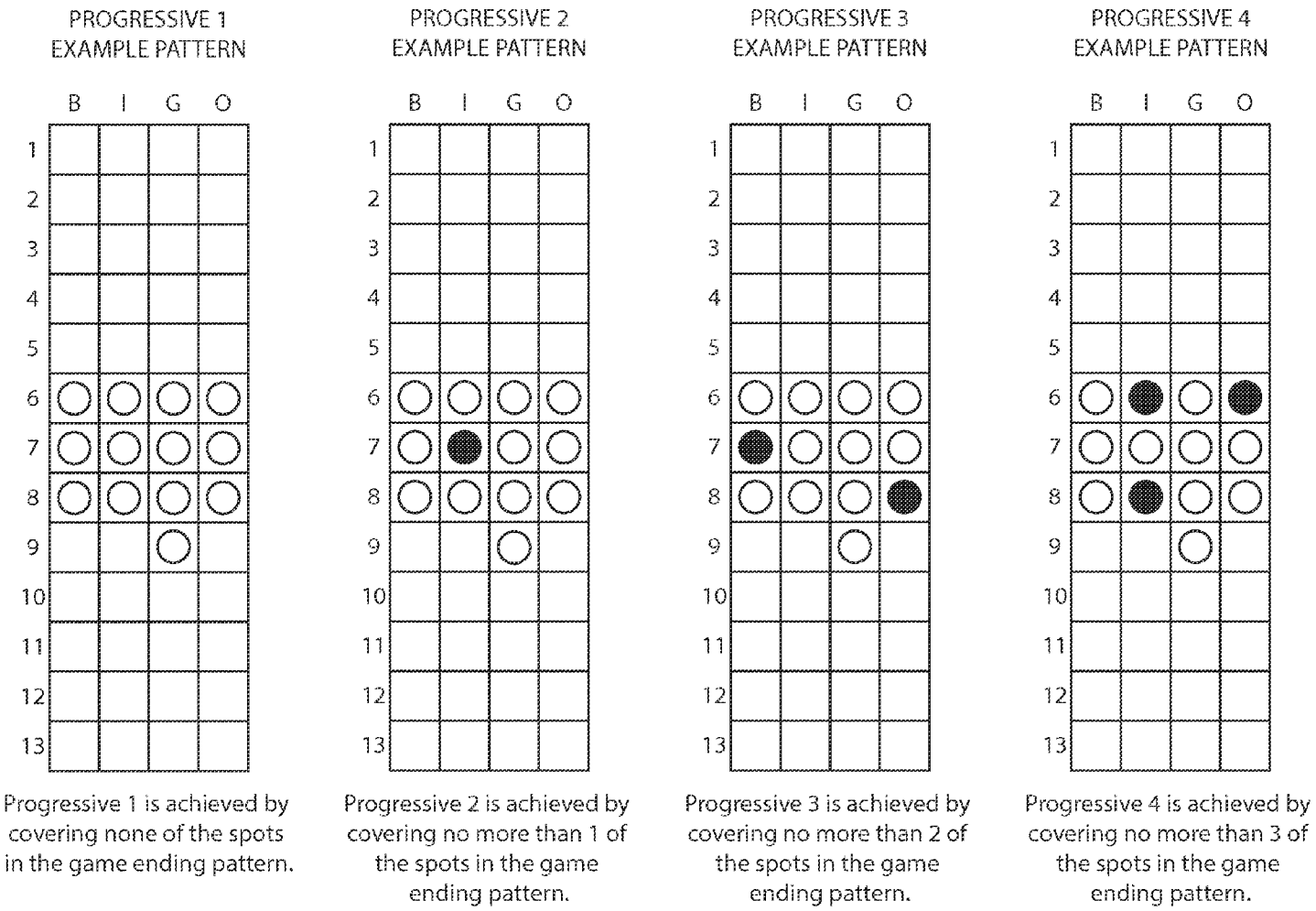
FIG. 9 is a flashboard showing exemplary embodiments of far-miss game ending patterns, according to one or more aspects of the present invention.

As each bingo ball is drawn, its corresponding space of each flashboard 72 is marked. In an embodiment where the 13-spot bingo card 70 is used without displaying the 52-space flashboard 72, a spot on the 13-spot bingo card 70 will only be marked when its corresponding bingo ball is drawn. Bingo balls are drawn and distributed to the player(s) until the first player has covered a predetermined game ending pattern of the 13-spot bingo card 70. At the time one player has achieved this game ending pattern for which he may or may not receive a prize, all other bingo cards 70 in play are evaluated based on how far they are away from achieving the game ending pattern. For example, if the game ending pattern is 13 spots on a bingo card 70, a player with only 1 spot marked in the predesignated game ending pattern has achieved a 12-spot far-miss (i.e. 13-spot pattern minus 1 spot marked). The fewer spots marked upon the game ending, the farther the miss of the player. FIG. 9 depicts exemplary far-miss bingo patterns upon game completion based on the 13-spot game ending pattern.

The probability of a player having no spots marked in the game ending bingo pattern on his bingo card 70 can be calculated based on the number of bingo cards 70 in play, the number of balls in the bingo ball population, and the number of spots in the game ending pattern. Since these probabilities can be calculated, winning criteria and prizes can be defined as depicted in the example prizes of FIG. 10 where 0 spots marked in the game ending pattern at the time another player achieves the game ending pattern results in winning the "Mega Jackpot" prize, only 1 spot marked results in achieving the "Super Jackpot" prize, only 2 spots marked awards the "Jackpot Prize", and only 3 spots marked achieves the "Mini-Jackpot" prize. The player that has marked all spots in the game ending pattern will be awarded a small game ending prize.

Figure 11:
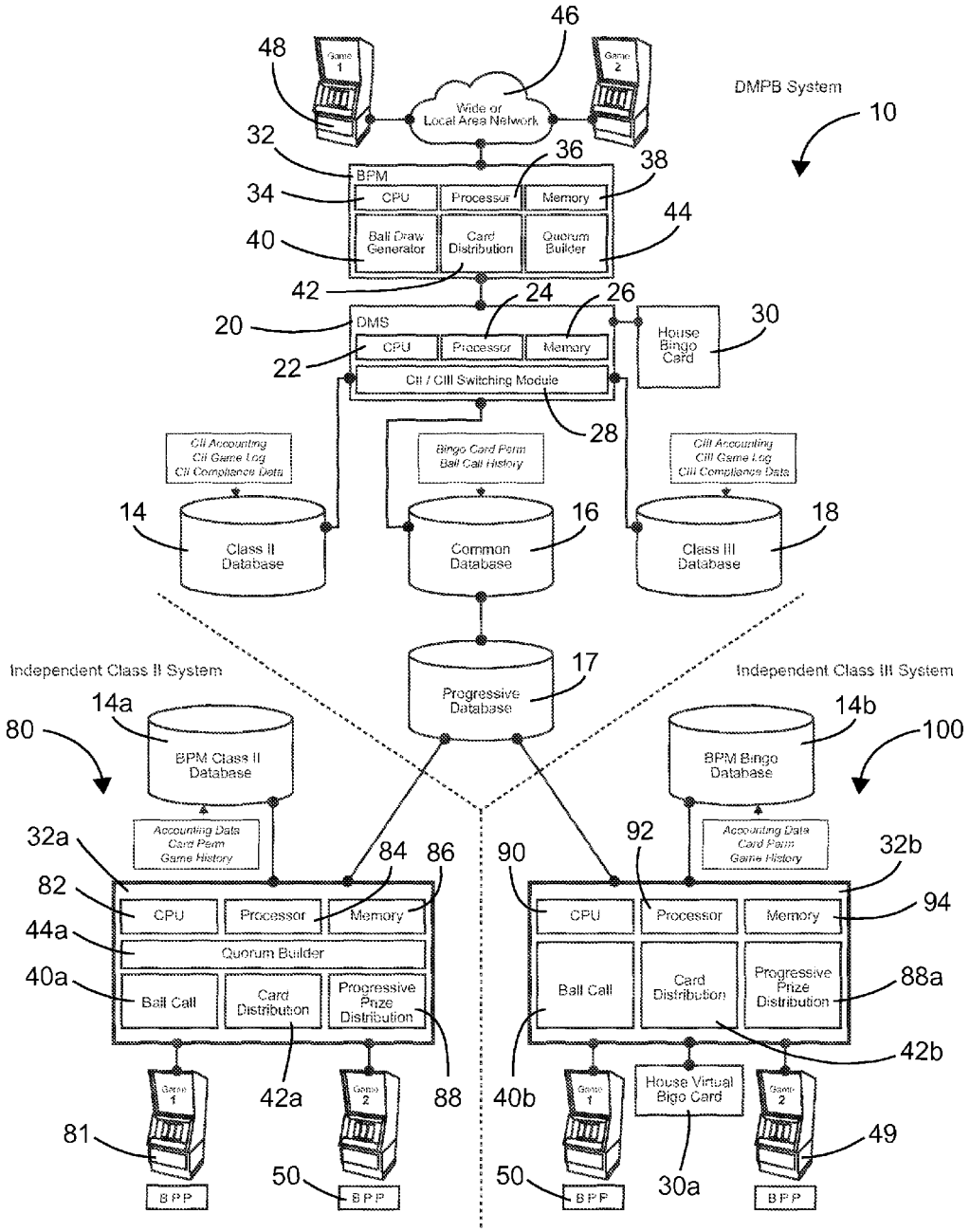
FIG. 11 is a diagram of an exemplary dual mode progressive bingo system with shared progressives between independent Class II and Class III systems, according to one or more aspects of the present invention.

As shown in FIG. 11, the DMPB system 10 may have a progressive database 17. Since the purpose of the BPM 32 is to broaden participation in bingo based progressive jackpots, the DMG System 12 can be configured to share only the BPM Progressive Jackpot database 17 of the DMPB system 10 between the DMPB system 10 and otherwise independent Class II system 80 and independent Class III system 100 as depicted in FIG. 11. Other configurations include removing the BPM 32*a*, 32*b* from the DMPB 10 and using it as a bonusing mechanism for an independent Class II system 80 or for standalone Class III system 100 gaming machines.

In this implementation, the BPM 32*a* used with the independent Class II system includes its own CPU 82, processor 84, and memory 86 and its own software components for building quorums 44*a*, generating ball calls 40*a*, distributing cards 42*a*, and distributing progressive prizes 88 to independent Class II gaming terminal 81 equipped with the BPP 50. A separate database 14*a* is used to store Class II data for the BPM 32*a*.

When used with an independent Class III system, the BPM 32*b* includes its own CPU 90, processor 92, and memory 94 and its own software components for generating ball calls 40*b*, distributing cards 42*b*, and distributing progressive prizes 88*a* to independent Class III gaming terminals 49 equipped with the BPP 50. In the Class III version of the BPM 32*b*, the quorum builder is replaced with a house bingo card 30*a*. A separate Class II-type bingo database 14*b* is used to store bingo data for the BPM 32*b*. In the independent Class III embodiment, the independent Class III Gaining Terminals 49 are responsible for their own Class III logging. Thus, a bingo database 14*b* is required to log information associated with the BPM 32*b* side game.

If desired, the BPM 32 can be removed entirely from the DMPB 10 to be used as a bonusing mechanism for Class II games 81. Class II games require a multiplayer, bingo based outcome generation system. In the case of Bingo Poker, this outcome generation system is tightly integrated with the game (play of the poker game directly relates to the bingo game), but often the bingo system is used only to generate a prize value and that prize value is revealed using an entertaining display otherwise unrelated to the bingo game.

The BPM 32 can be used as a complete outcome determination system to drive a non-bingo display in Class II installations or the BPM 32*a* can be added as a separate Class II side game utilizing the BPP 50 to Class II games with their own outcome generation system. Whether using the BPM 32 as an integrated Class II outcome generation system or using it with games that include their own Class II outcome generation system 81, the Bingo Progressive Module 32 itself is a bingo game that meets Class II regulations.

Figure 11A:
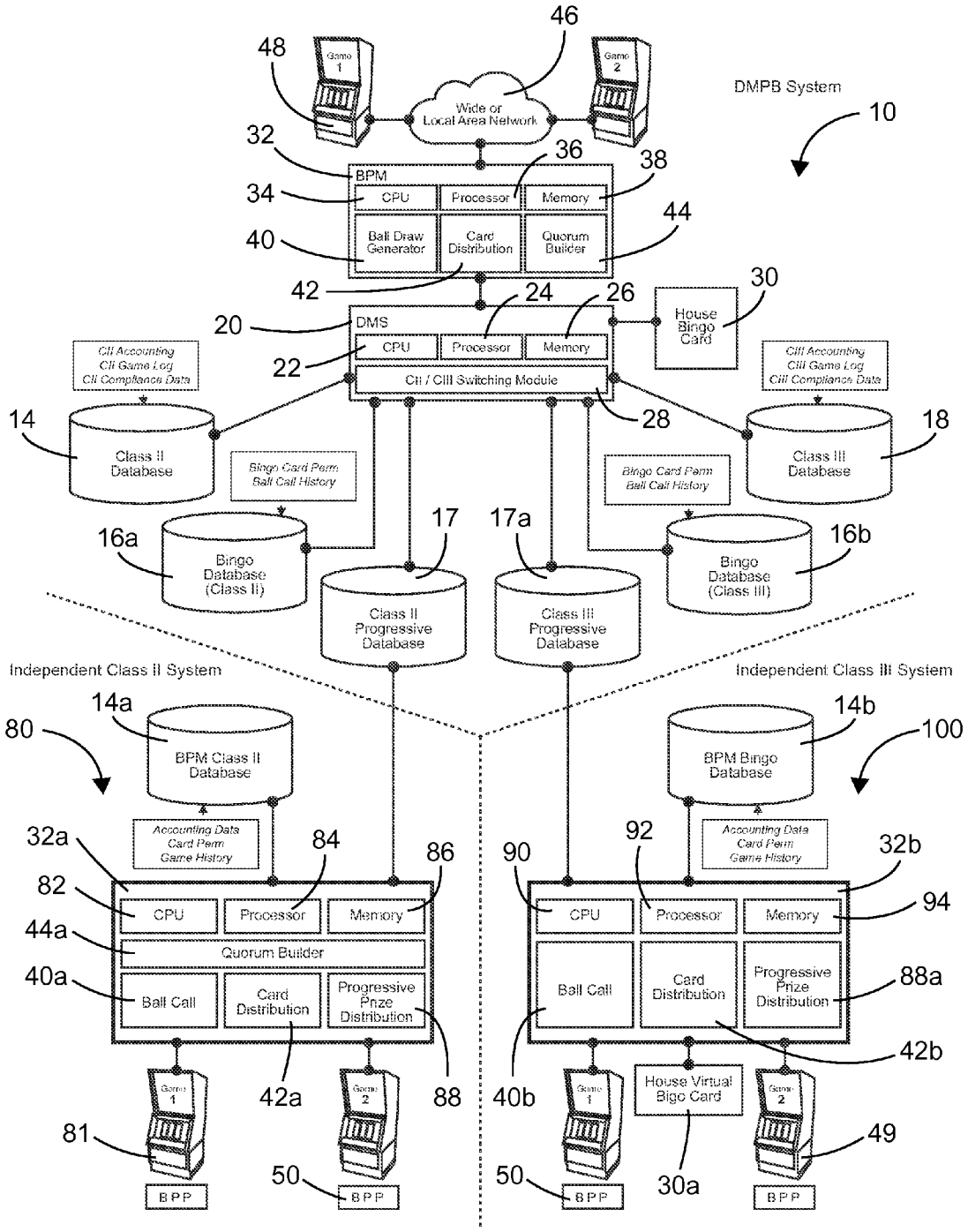
FIG. 11*a* is a diagram of an exemplary dual mode progressive bingo system with shared progressives between independent Class II and Class III systems with separate progressive databases for the Class II and Class III systems, according to one or more aspects of the present invention.

FIG. 11*a* is an alternate embodiment of the system depicted in FIG. 11 where a second progressive database 17*a* has been added for Class III games only to be used in jurisdictions that prohibit the commingling of prizes between Class II and Class III systems. Similar to the Progressive Database (Class II) 17, the Class III Progressive Database 17*a* stores the progressive prize information described in FIG. 10, but that is only available to Class III games and games played by the DMPB as Class III games. In this embodiment, games played by the DMPB as Class II games can share progressive prizes with Independent Class II Systems 80 and games played as Class III games by the DMPB 10 can share progressive prizes with Independent Class III systems 100. All other components in FIG. 11*a* perform the same functions as those described for FIG. 11.

Figure 12:
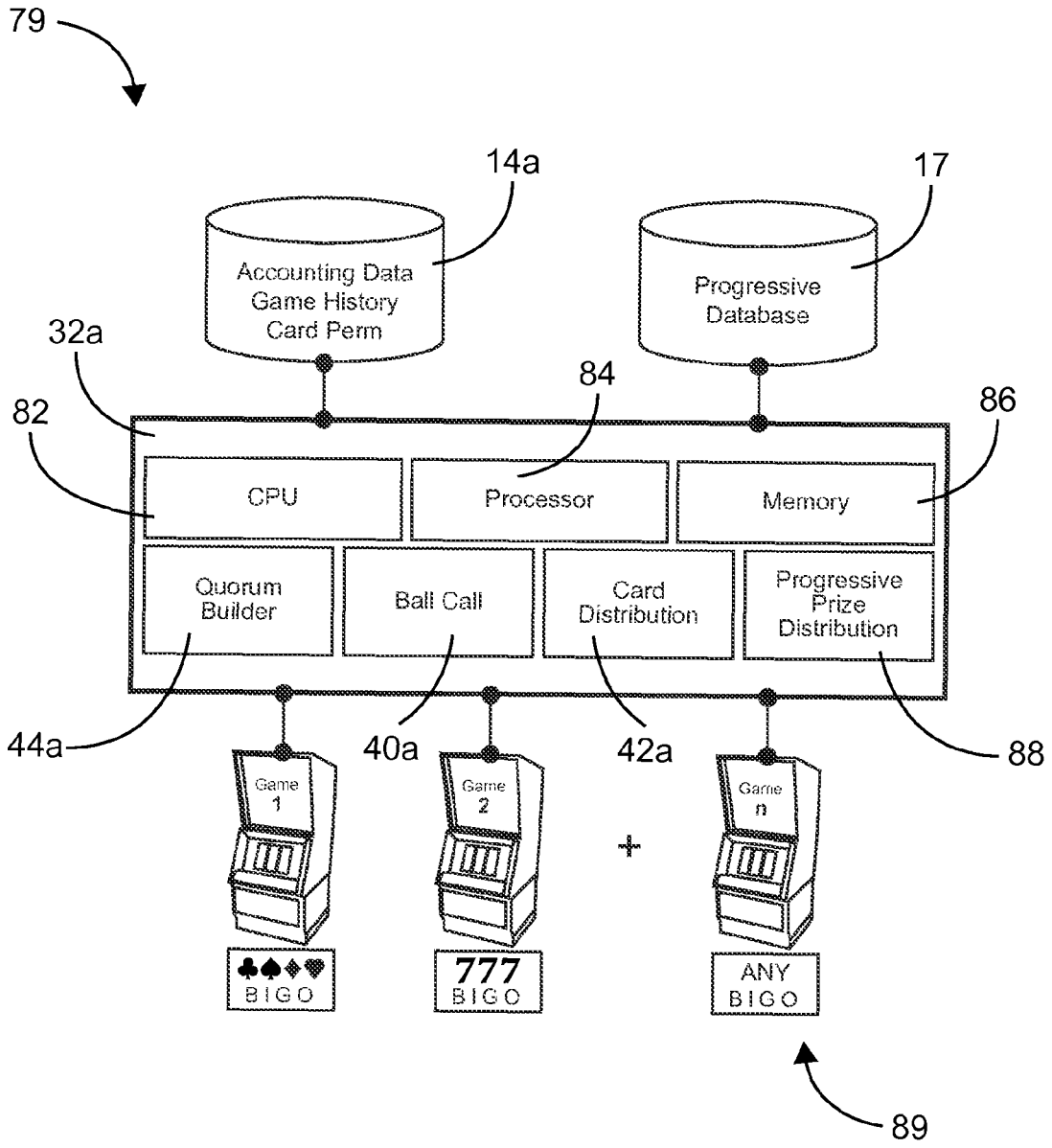
FIG. 12 is an exemplary Class II system architecture diagram with a bingo progressive module as both outcome generator and bonusing mechanism, according to one or more aspects of the present invention.

FIG. 12 illustrates one embodiment of the Bingo Progressive Module 32*a* (referred to generically as Bingo Progressive Module 32), wherein the BPM 32*a* is used as an integrated Class II bingo outcome generation system 79 including all components required for Class II gaming: a CPU 82, processor 84, and memory 86, a quorum builder 44*a*; a ball call system 40*a*; a bingo card distribution system 42*a*; a progressive prize distribution system 88; a bingo database 14*a* for providing accounting data, game history, and bingo card permutations (perms); and a plurality of gaming terminals 89 with an integrated class II bingo interface that do not use a BPP 50. The BPM 32*a* could also be used as a bonusing mechanism for the independent Class II system 80 simply by removing the quorum builder 44*a*. The progressive database 17 enables large jackpot prizes.

Games may be a mix of a wide variety of game formats including Bingo Poker using a dual card perm and other games including bingo based slot games that may use a single persistent bingo card perm with a random number generator (RNG) for indicia distribution or dual card perm (see Bingo Poker U.S. Pat. No. 8,752,838 for an explanation of dual card perm) depending on the game design.

Figure 13:
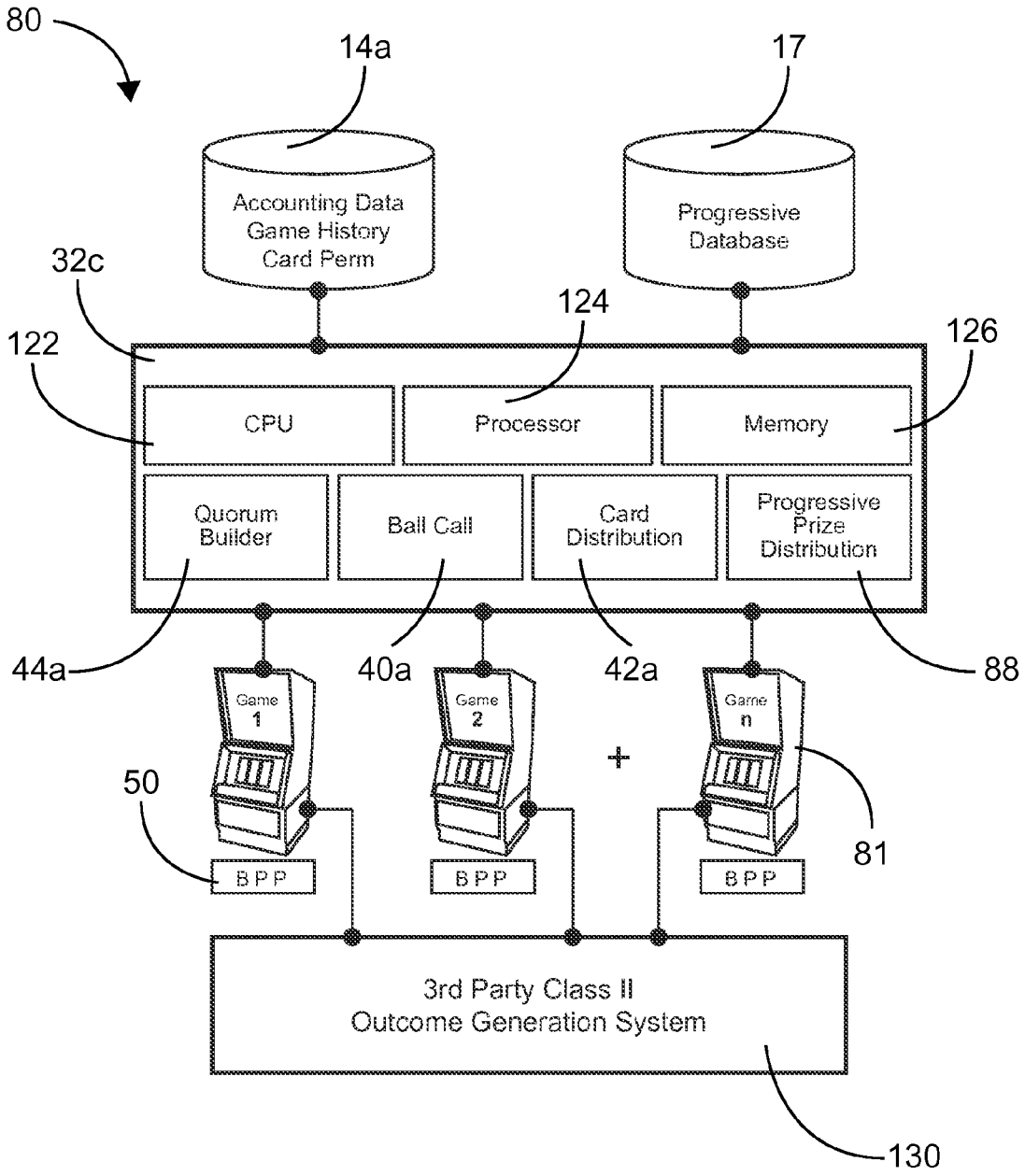
FIG. 13 is an exemplary Class II system architecture diagram with a bingo progressive module as a bonusing mechanism only for an independent Class II system, according to one or more aspects of the present invention.

FIG. 13 illustrates another embodiment of the Bingo Progressive Module 32*c* (referred to generically as Bingo Progressive Module 32), wherein the BPM 32*c* is used as only a bonusing mechanism with an independent Class II system 80. FIG. 13 illustrates the system architecture when using the Bingo Progressive Module 32*c* only as a side game bonusing mechanism as an add-on to an otherwise independent Class II bingo system 80. In this case, all of the components of the BPM 32*a* are provided, but the Gaming Terminals 124 include a second connection to a third party Class II outcome generation system 130. In this configuration, the game screen 140 depicted in FIG. 14 will display two bingo games: the bingo game 142 facilitated by the independent third party Class II bingo system 130 and the BPM 32*c* bingo game and progressives displayed using the BPP interface 50.

Figure 14:
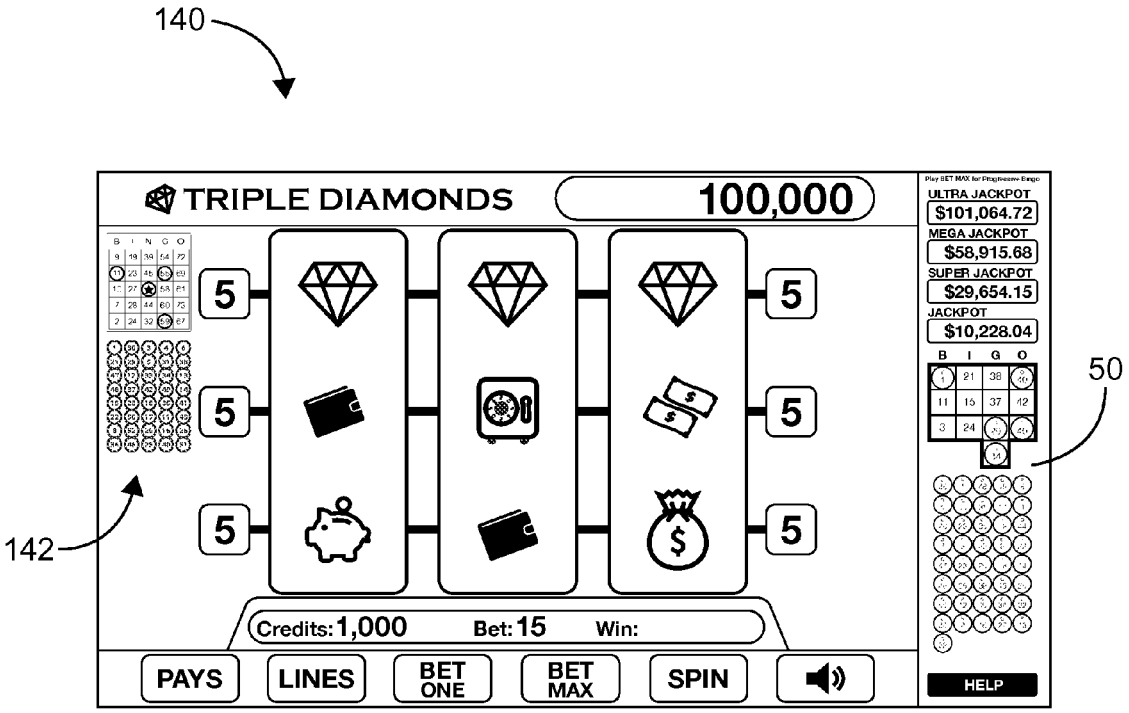
FIG. 14 is an exemplary game screen for an independent Class II game with a bingo progressive plug-in as a bonusing mechanism, according to one or more aspects of the present invention.

This embodiment includes the components of the BPM 32*c* with its own CPU 122, processor 124, and memory 126 and accompanying software components for building quorums 44*a*, calling balls 40*a*, distributing bingo cards 42*a*, and distributing progressive prizes 88. The BPP 50 is used on the independent Class II gaming terminals 81 to provide the progressive bingo game display (FIG. 14).

Figure 15:
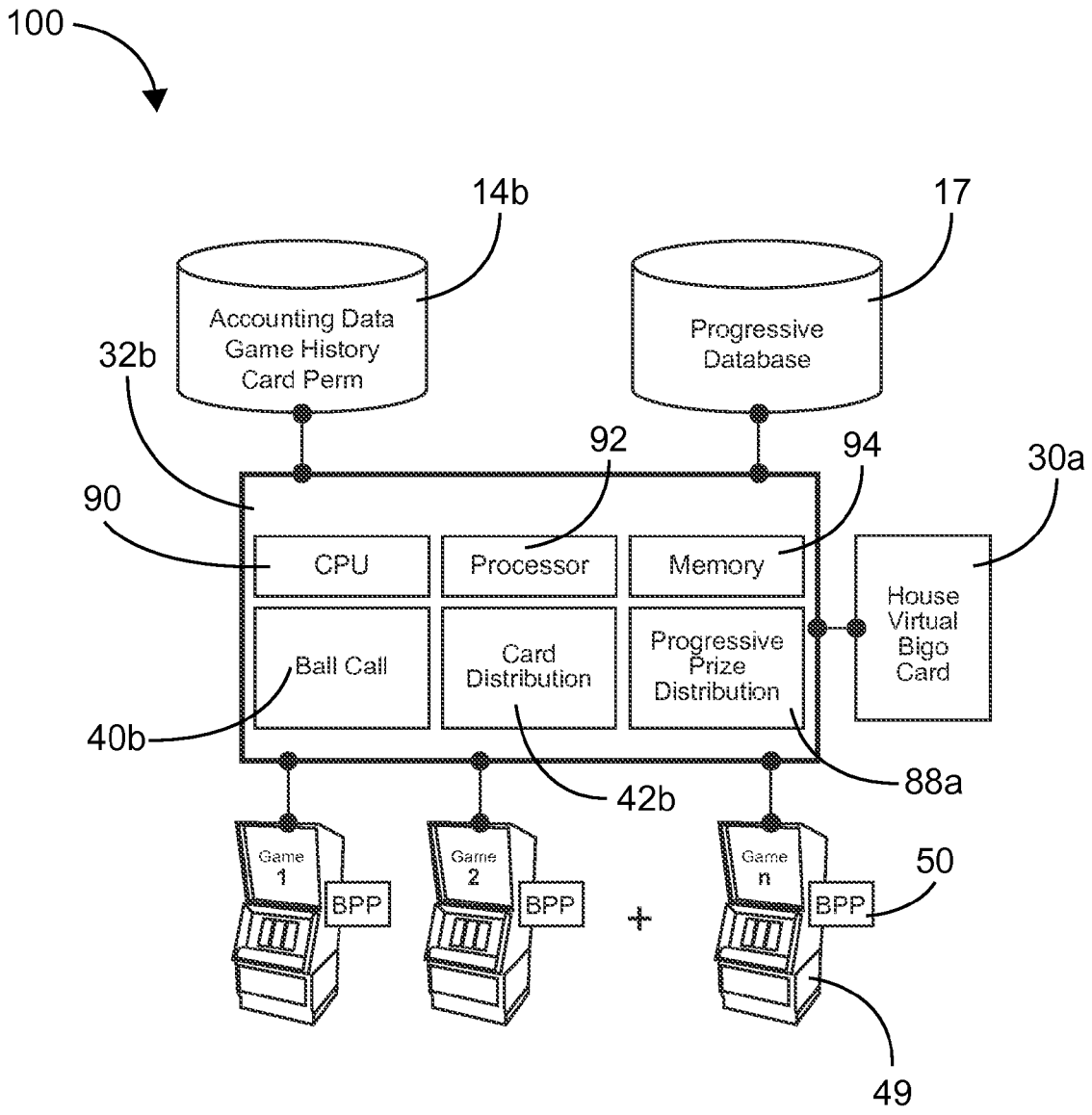
FIG. 15 is an exemplary system architecture diagram for a Class III system with a bingo progressive plug-in as a bonusing mechanism only, according to one or more aspects of the present invention.

Similar to the Class II variations leveraging the BPM 32*a*, 32*c* without the full DMPB 10 system, the BPM 32*b* (referred to generically as Bingo Progressive Module 32), according to another embodiment, can be removed from the DMPB 10 and used as an independent bonusing mechanism for Class III gaming terminals 49. The independent Class III system 100 implementation has one major difference from the independent Class II system 80 implementation. The second bingo card used to determine if the player has won any of the progressive prizes or not may be a virtual card 30*a* played by a computer representing the operator with the restriction that the operator's bingo card is not eligible to win the progressives. FIG. 15 depicts the independent Class III system 100 architecture for using the BPM 32*b* independent of the DMPB 10. In this implementation, the Gaming Terminals 49 generate their own game outcomes typically using an internal random number generator. The BPM 32*b* includes its own CPU 90, processor 92, and memory 94 and is modified to include only a ball calling system 40*b*, a card distribution system 42*b*, and a progressive prize distribution system 88*a*. The quorum building system 44*a* that was present in the independent Class II system 80 has been removed and replaced with a virtual bingo card 30*a* used to achieve the game ending pattern, but that cannot win progressive prizes. The progressive database 17 and the Class II-type bingo database 14*b* complete the Class III variation of the system 100. The bingo database 14*b* is used for logging information associated with the bingo based bonusing game provided by the BPM 32*b*. Like the independent Class II system 80 variation, gaming terminals may leverage the BPP 50 to display the bingo game and base games may be a mix of a wide variety of game formats including Bingo Poker, bingo based slot games, or others.

Figure 16:
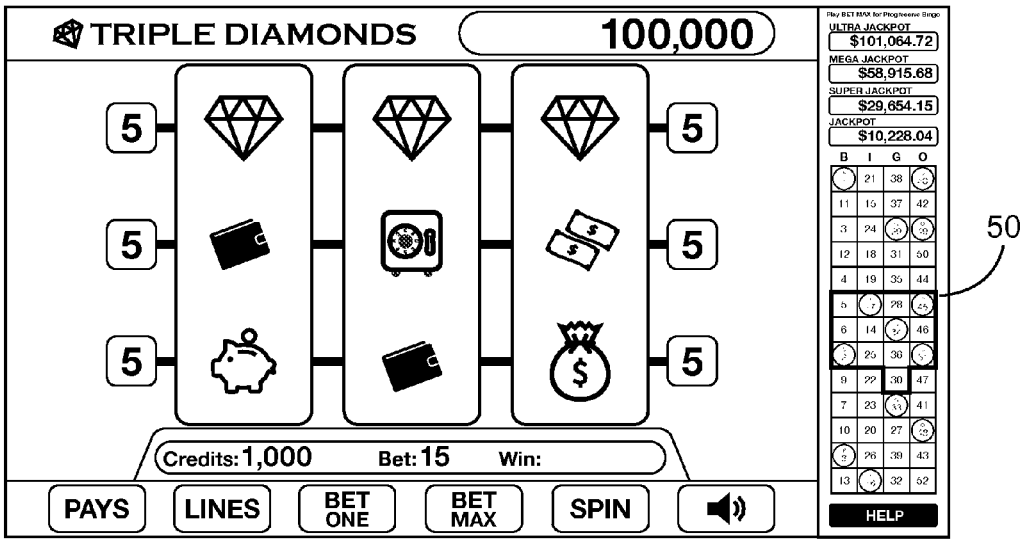
FIG. 16 is an exemplary game screen of an independent Class III game with a bingo progressive plug-in bonus game with a flashboard-style bingo card, according to one or more aspects of the present invention.

The Class III game screen with the BPP 50 is depicted in FIG. 16.

Figure 17:
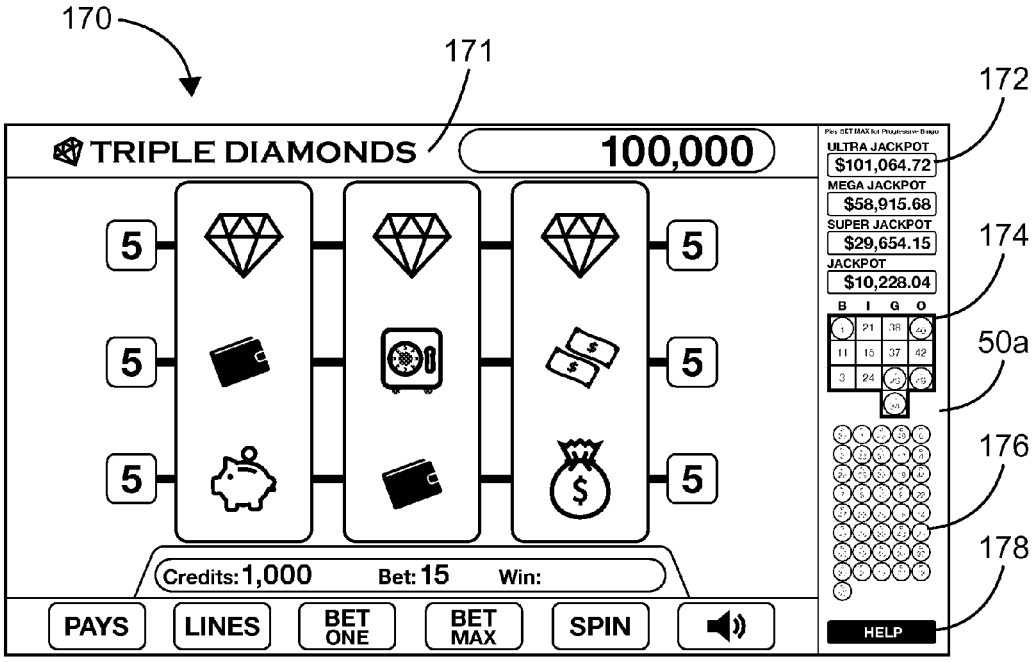
FIG. 17 is an exemplary game screen of an independent Class III game with a bingo progressive plug-in bonus game with card-style display, according to one or more aspects of the present invention.
Figure 18:
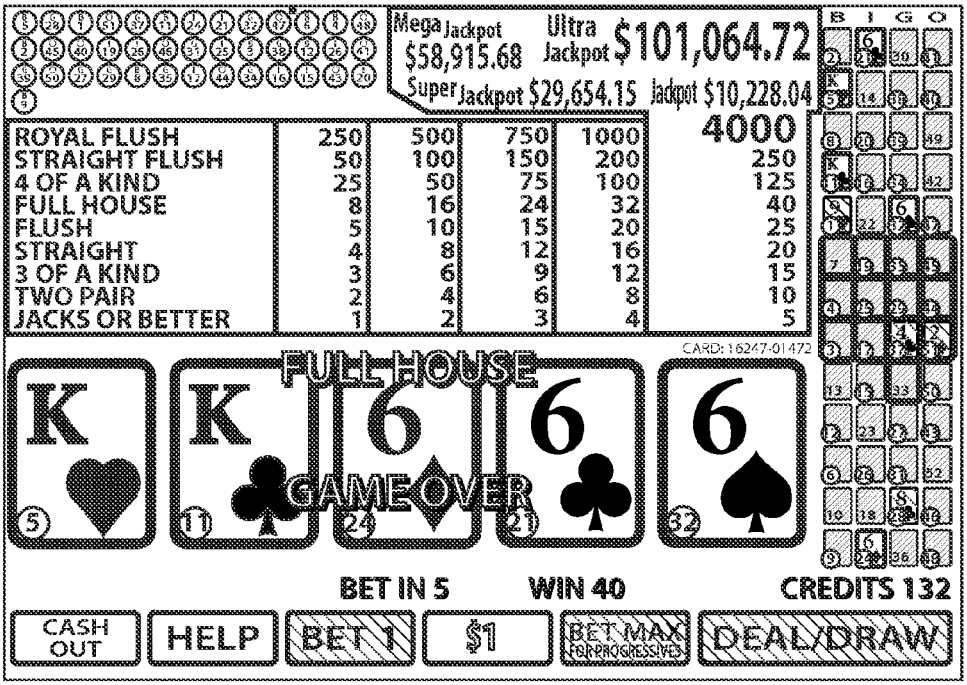
FIG. 18 is an exemplary native dual mode progressive bingo game screen for "Bingo Poker" with flashboard-style display, according to one or more aspects of the present invention.
Figure 19A:
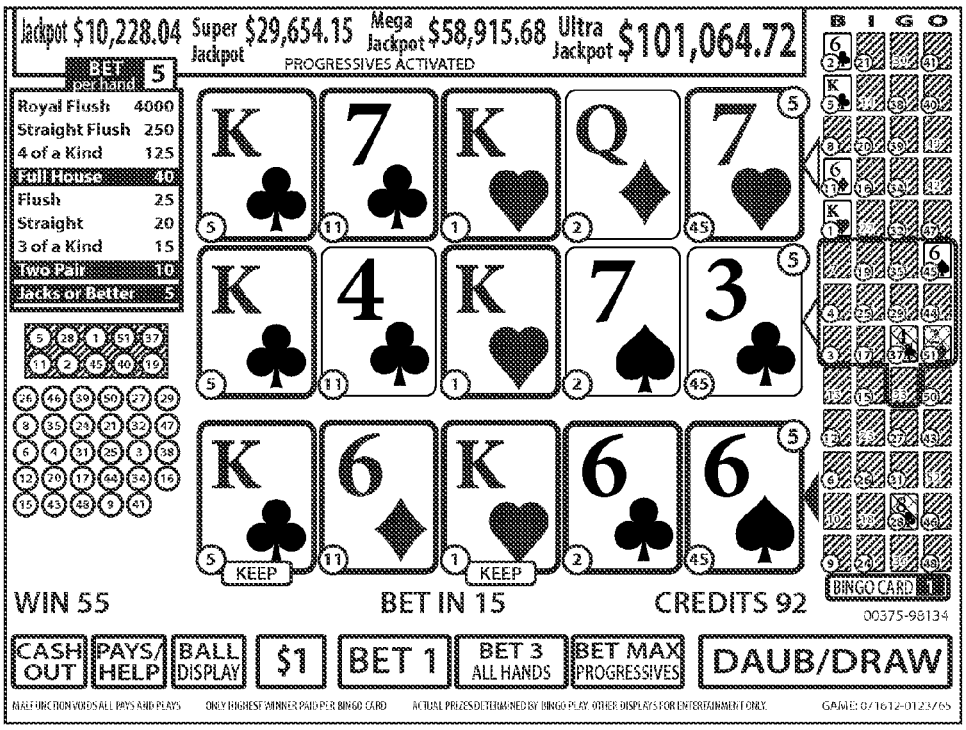
FIG. 19*a* is an exemplary native dual mode progressive bingo game screen for "Spot the Daub" with flashboard-style bingo display and card deck style skill game display, according to one or more aspects of the present invention.
Figure 19B:
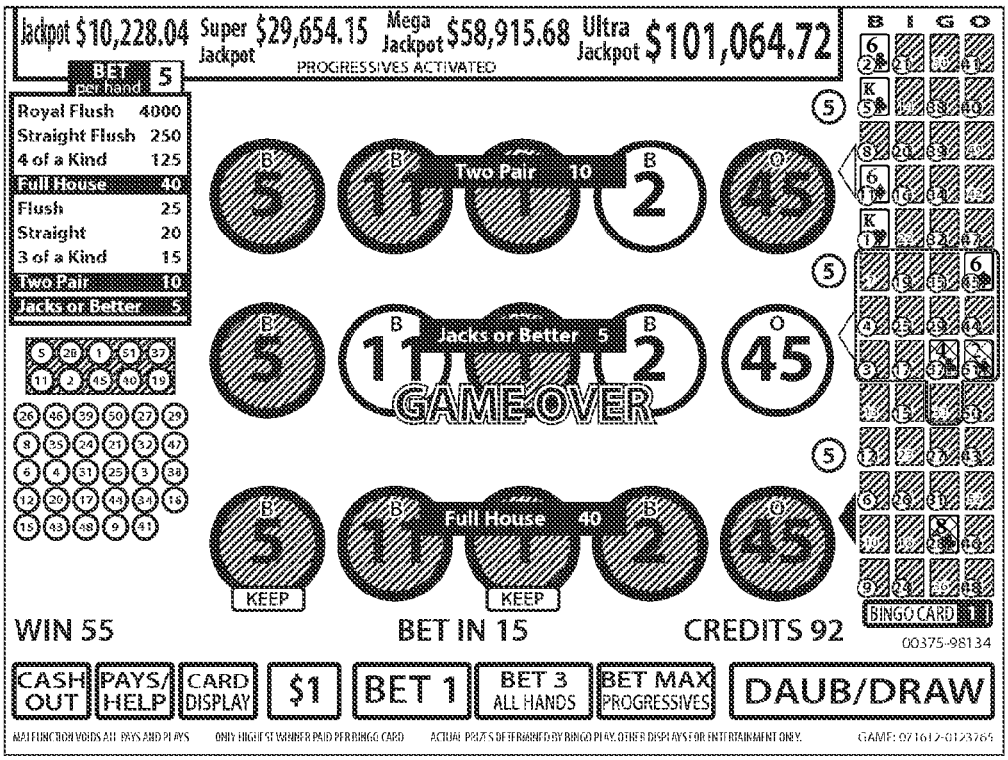
FIG. 19*b* is an exemplary native dual mode progressive bingo game screen for "Spot the Daub" with flashboard-style display and bingo ball-style skill game display, according to one or more aspects of the present invention.
Figure 20:
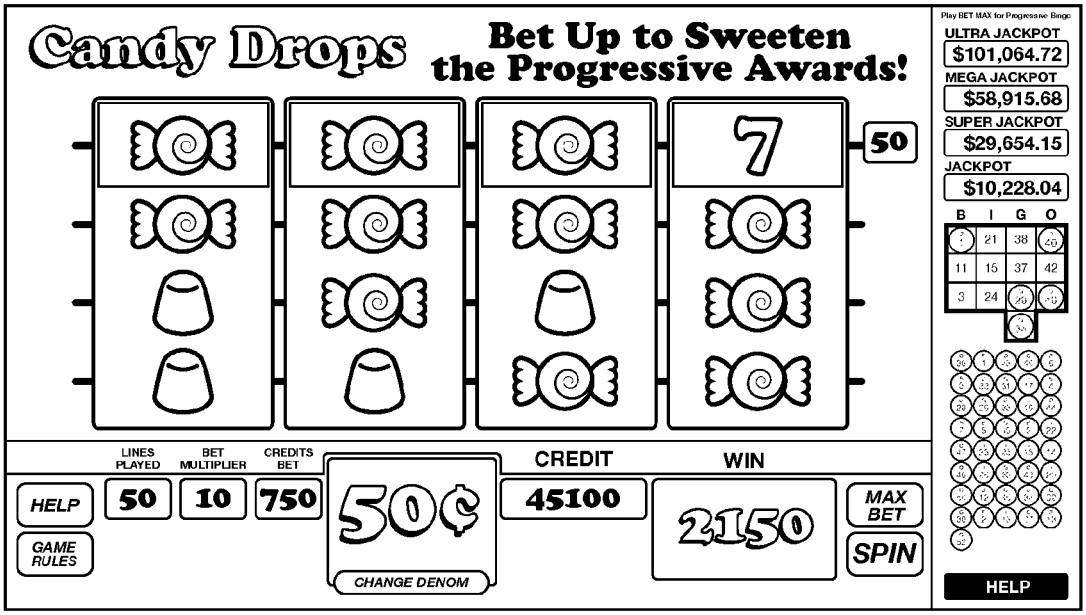
FIG. 20 is an exemplary native dual mode progressive bingo game screen for "Candy Drops" with card-style display, according to one or more aspects of the present invention.
Figure 21:
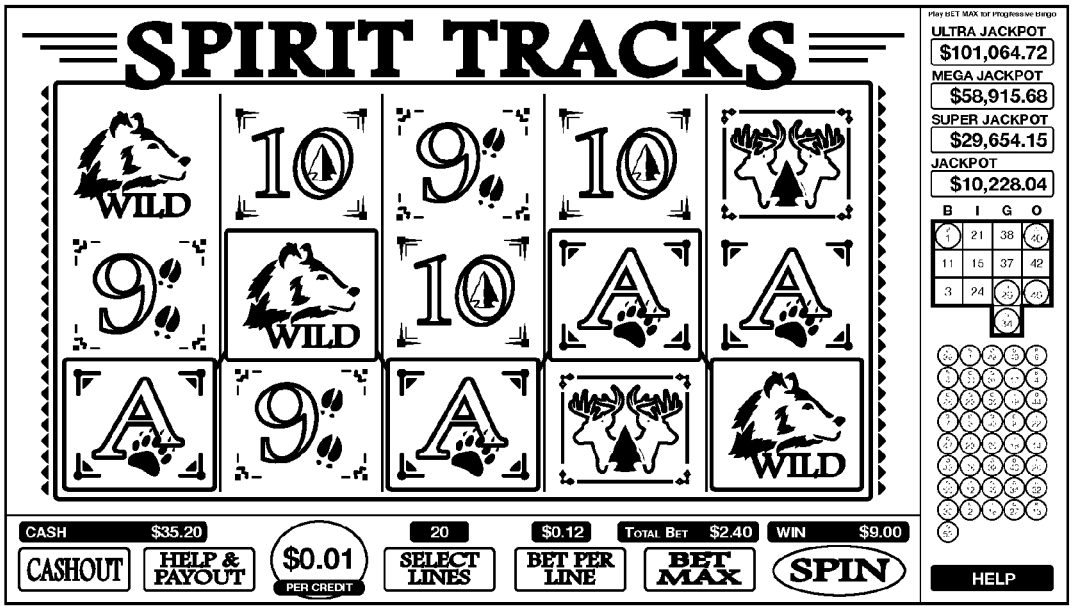
FIG. 21 is an exemplary native dual mode progressive bingo game screen for "Spirit Tracks" with card-style display, according to one or more aspects of the present invention.
Figure 22:
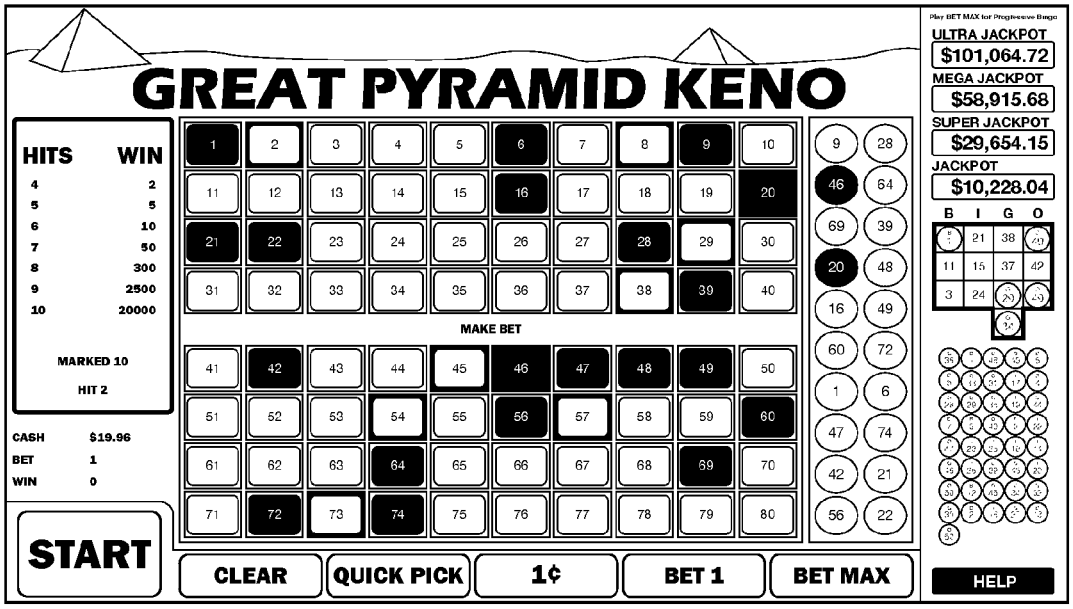
FIG. 22 is an exemplary native dual mode progressive bingo game screen for "Great Pyramid Keno" with card-style display, according to one or more aspects of the present invention.
Figure 23:
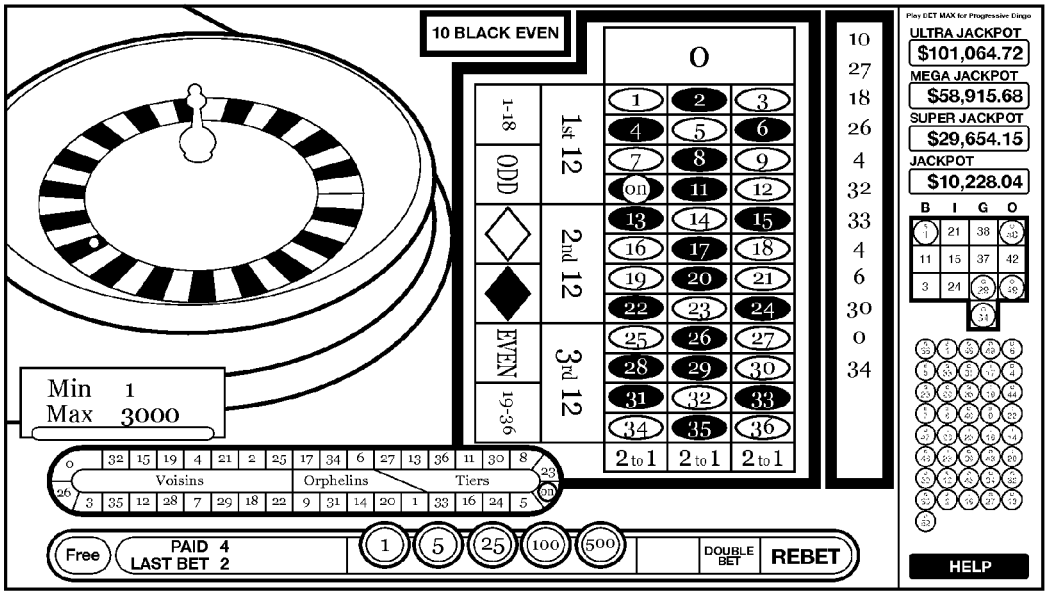
FIG. 23 is an exemplary native dual mode progressive bingo game screen for "Roulette" with card-style display, according to one or more aspects of the present invention.

The BPM 32 outcome generation system (ball call 40, card distribution 42, and quorum builder 44 when appropriate) of the DMPB 10 can be used to generate outcomes for Class II machines or as a side game to virtually any game design. FIGS. 17-23 depict a variety of game design variations possible using the BPP 50. FIG. 17 depicts a Class III game and with an alternate version of the BPP 50*a*. The complete game screen 170 includes the base game 171 and the BPP 50*a* consisting of the ball call 176, the player's bingo card 174, the progressive jackpot values 172, and a help button 178 with additional player information about the BPM 32. FIG. 17 is a depiction of the BPP 50*a* on the right side of a three reel slot style game design. FIG. 16 includes an alternate style BPP 50 using a flashboard style display.

The math behind the BPM 32 is straight forward, but the volume of transactions makes the implementation of this game impractical without a computer network 46.

The bingo game that facilitates the progressive wins must keep pace with any base game to which it is paired. In a typical casino style gaming environment, a single game may be as short as two seconds. The computer aided gaming terminal is an important tool for the player to facilitate marking and managing bingo cards quickly. The computer server system is critical to managing and accounting for the thousands of game plays per minute that occur.

For example, a casino game with the BPP 50 side game may play approximately 20 games per minute. If there are 10,000 machines on the network, the transaction rate can be as high as 200,000 games per minute or well over 3,000 games per second. Accounting for this many transactions requires one or more servers to receive the game play wager data, calculate the amount to contribute to one or more progressive pools, distribute bingo balls to each gaming terminal, evaluate each bingo card in play to determine if a winner is present, and finally send the winning or losing information to each gaming terminal.

In addition, the volume of transactions requires a computer system to properly calculate progressive jackpot prizes. Progressive jackpots are prizes that receive a contribution from each bet made on a gaming terminal. As a result, these prizes grow or "progress" over time to larger values until won by one or more players achieving the win criteria. The jackpots reset to a pre-designated starting value using either a seed amount or funded reserve amount immediately after being won by a player. Since the jackpots can be added to any Class II or Class III base game, the contribution from the player's wager must be calculated. For each wager, the base game shares the bet amount with the BPM 32 system. The BPM 32 system allocates a percentage of this bet to one or more progressive meters. Typically this amount is a small contribution such as 0.12% to 1% of the wager. This contribution is added to the balance of the progressive and the jackpot displays on the BPP interface 50 are updated across the network 46.

FIG. 24 illustrates one design for the far-miss progressive jackpots based on a 13 spot game ending pattern. This design separates each bet into 20 accounts (5 per progressive jackpot) where each jackpot has a primary jackpot value (this is the prize players are actively trying to win) and four reserve accounts. Each account is funded with a percentage of the wager. In this case, 0.04% of the wager is allocated to the Primary account for each jackpot, and 0.02% is allocated to each Reserve account for each wager. The combined total allocated to each jackpot is 0.12% and the combination of wager allocations for all 4 progressives is 0.48%.

When a jackpot is won by a player, each reserve account is promoted. For example, when a player wins the jackpot of the $4^{th}$ progressive above, the player will receive the balance of the Primary account and Reserve 1 will become the new Primary account. Reserve 2 is promoted to Reserve 1 and so forth. Reserve 4 is promoted to Reserve 3 and the balance of Reserve 4 is reset to zero. This system ensures there will always be an attractive balance for each Primary jackpot account being displayed to players.

The foregoing description is illustrative of particular embodiments of the application, but is not meant to be limitation upon the practice thereof. While embodiments of the disclosure have been described in terms of various specific embodiments, those skilled in the art will recognize that the embodiments of the disclosure may be practiced with modifications within the spirit and scope of the claims.

What is claimed is:

1. A dual mode progressive bingo video gaming system comprising:

a plurality of gaming terminals connected to the dual mode progressive bingo video gaming system;

each gaming terminal comprising a housing, a plurality of input devices supported by the housing, the plurality of input devices including an acceptor configured to receive a wager and establish a credit balance;

a database to record activity on games played on the dual mode progressive bingo video gaming system under Class II gaming rules;

a database to record activity on games played on the dual mode progressive bingo video gaming system under Class III gaming rules;

a shared database for storing progressive information for all games played on the dual mode progressive bingo video gaming system under Class II gaming rules and under Class III gaming rules;

a progressive database to connect to an independent Class II gaming system and an independent Class III gaming system so that a progressive jackpot may be shared among all of the games being played on the dual mode progressive video gaming system, the independent Class II gaming system, and the independent Class III gaming system; and a dual mode gaming system comprising:

a switching logic to switch automatically between Class II gaming rules and Class III gaming rules on a play by play basis based on availability of players to create a quorum;

a bingo progressive module for adding bingo-based far-miss progressive jackpots to any game played on the dual mode progressive bingo video gaming system, the bingo progressive module having a ball call system, a quorum builder, and a bingo card distribution system;

a virtual bingo card that is played by the dual mode gaming system when a game is being played under Class III gaming rules;

a processor for executing program instructions and a memory coupled to the processor for storing program instructions, the programming instructions comprising:

receiving at least one play request from at least one player;

continuously monitoring whether another play request is received from at least another player;

determining whether a quorum of players is established within a predetermined period of time;

initiating a bingo game under one of Class II gaming rules and Class III gaming rules for the at least one player depending upon whether the quorum of players is established within the predetermined period of time; and ending the bingo game when a bingo card of a player has achieved a predetermined game ending pattern, wherein the independent Class II gaming system comprises:

an independent Class II database;

an independent ball call system;

an independent bingo card distribution system;

an independent progressive prize distribution system;

at least one independent Class II gaming terminal; and an independent quorum builder; and wherein the at least one independent Class II gaming terminal is connected to the dual mode progressive bingo video gaming system through a bingo progressive plug-in interface and wherein the bingo progressive plug-in interface appears as a side game to a base game being played on the at least one independent Class II gaming terminal.

2. The dual mode progressive bingo video gaming system of claim 1, wherein the switching logic initiates a multiplayer bingo game under Class II gaming rules when a quorum of players is established within the predetermined period of time.

3. The dual mode progressive video gaming system of claim 1, wherein any play with a quorum of players is logged into the Class II database.

4. The dual mode progressive video gaming system of claim 1, wherein the switching logic initiates a single player bingo game under Class III gaming rules when a quorum of players is not established within the pre-determined period of time.

5. The dual mode progressive video gaming system of claim 1, wherein any play with only one player will be logged in the Class III database.

6. The dual mode progressive video gaming system of claim 1, wherein all logging information for games played under Class II gaming rules and games played under Class III gaming rules are stored in the common database.

7. The dual mode progressive video gaming system of claim 1 further comprising a management terminal for generating reports from any of the databases.

8. The dual mode progressive video gaming system of claim 1, wherein the gaming terminals are connected natively to the dual mode progressive bingo video gaming system.

9. The dual mode progressive video gaming system of claim 1, wherein the bingo progressive module may be used as at least one of an outcome generator and a bonusing mechanism for the independent Class II gaming system.

10. The dual mode progressive video gaming system of claim 1, wherein the independent Class III gaming system comprises:

an independent Class III database;

an independent ball call system;

an independent bingo card distribution system;

an independent progressive prize distribution system;

at least one independent Class III gaming terminal; and a virtual bingo card that is played by the independent Class III gaming system.

11. The dual mode progressive video gaming system of claim 10, wherein the at least one independent Class III gaming terminal connected to the dual mode progressive bingo video gaming system through a bingo progressive plug-in interface and wherein the bingo progressive plug-in interface appears as a side game to a non-bingo base game being played on the at least one independent Class III gaming terminal.

12. The dual mode progressive video gaming system of claim 10, wherein the bingo progressive module may be used as only a bonusing mechanism for the independent Class III gaming system.

13. The dual mode progressive video gaming system of claim 1, wherein the bingo progressive module may be separated from the dual mode progressive video gaming system and used as a bonusing mechanism with at least one of an independent Class II gaming system and an independent Class III gaming system.

14. The dual mode progressive video gaming system of claim 1, wherein the programming instructions further comprises the steps of:

awarding a prize to the player whose bingo card has achieved the predetermined game ending pattern; and awarding a far-miss progressive jackpot to another player whose bingo card has no markings on the predetermined game ending pattern.

15. The dual mode progressive video gaming system of claim 1, wherein the programming instructions further comprises the steps of:

awarding a prize to the player whose bingo card has achieved the predetermined game ending pattern; and awarding a far-miss progressive jackpot to the same player for having a second bingo card that has no markings on the predetermined game ending pattern.

16. A dual mode progressive bingo video gaming system comprising:

a plurality of gaming terminals connected to the dual mode progressive bingo video gaming system;

each gaming terminal comprising a housing, a plurality of input devices supported by the housing, the plurality of input devices including an acceptor configured to receive a wager and establish a credit balance;

a database to record activity on games played on the dual mode progressive bingo video gaming system under Class II gaming rules;

a database to record activity on games played on the dual mode progressive bingo video gaming system under Class III gaming rules;

a shared database for recording game history and storing progressive information for all games played on the dual mode progressive bingo video gaming system under Class II gaming rules and under Class III gaming rules;

a progressive database to connect to an independent Class II gaming system and an independent Class III gaming system so that a progressive jackpot may be shared among all of the games being played on the dual mode progressive video gaming system, the independent Class II gaming system, and the independent class III gaming system; and a dual mode gaming system comprising:

a switching logic to switch automatically between Class II gaming rules and Class III gaming rules on a play by play basis based on availability of players to create a quorum;

a bingo progressive module for adding bingo-based far-miss progressive jackpots to any game played on the dual mode progressive bingo video gaming system, the bingo progressive module having a ball call system, a quorum builder, and a bingo card distribution system;

a virtual bingo card that is played by the dual mode gaming system when a game is being played under Class III gaming rules;

a processor for executing program instructions and a memory coupled to the processor for storing program instructions, the programming instructions comprising:

receiving at least one play request from at least one player;

continuously monitoring whether another play request is received from at least another player;

determining whether a quorum of players is established within a predetermined period of time;

initiating a bingo game under one of Class II gaming rules and Class III gaming rules for the at least one player depending upon whether the quorum of players is established within the predetermined period of time; and ending the bingo game when a bingo card of a player has achieved a predetermined game ending pattern, wherein the independent Class II gaming system comprises:

an independent Class II database;

an independent ball call system;

an independent bingo card distribution system;

an independent progressive prize distribution system;

at least one independent Class II gaming terminal; and an independent quorum builder, and wherein the at least one independent Class II gaming terminal is connected to the dual mode progressive bingo video gaming system through a bingo progressive plug-in interface and wherein the bingo progressive plug-in interface appears as a side game to a base game being played on the at least one independent Class II gaming terminal.

17. The dual mode progressive bingo video gaming system of claim 16, wherein the switching logic initiates a multi-player bingo game under Class II gaming rules when a quorum of players is established within the predetermined period of time.

18. The dual mode progressive video gaming system of claim 16, wherein any play with a quorum of players is logged into the Class II database.

19. The dual mode progressive video gaming system of claim 16, wherein the switching logic initiates a single player bingo game under Class III gaming rules when a quorum of players is not established within the pre-determined period of time.

20. The dual mode progressive video gaming system of claim 16, wherein any play with only one player will be logged in the Class III database.

21. The dual mode progressive video gaming system of claim 16, wherein all logging information for games played under Class II gaming rules and games played under Class III gaming rules are stored in the common database.

22. The dual mode progressive video gaming system of claim 16 further comprising a management terminal for generating reports from any of the databases.

23. The dual mode progressive video gaming system of claim 16, wherein the gaming terminals are connected natively to the dual mode progressive bingo video gaming system.

24. The dual mode progressive video gaming system of claim 16, wherein the bingo progressive module may be used as at least one of an outcome generator and a bonusing mechanism for the independent Class II gaming system.

25. The dual mode progressive video gaming system of claim 16, wherein the independent Class III gaming system comprises:

an independent Class III database;

an independent ball call system;

independent bingo card distribution system;

an independent progressive prize distribution system;

at least one independent Class III gaming terminal; and a virtual bingo card that is played by the independent Class III gaming system.

26. The dual mode progressive video gaming system of claim 25, wherein the at least one independent Class III gaming terminal connected to the dual mode progressive bingo video gaming system through a bingo progressive plug-in interface and wherein the bingo progressive plug-in interface appears as a side game to a non-bingo base game being played on the at least one independent Class III gaming terminal.

27. The dual mode progressive video gaming system of claim 25, wherein the bingo progressive module may be used as only a bonusing mechanism for the independent Class III gaming system.

28. The dual mode progressive video gaming system of claim 16, wherein the bingo progressive module may be separated from the dual mode progressive video gaming system and used as a bonusing mechanism with at least one of an independent Class II gaming system and an independent Class III gaming system.

29. The dual mode progressive video gaming system of claim 16, wherein the programming instructions further comprises the steps of:

awarding a prize to the player whose bingo card has achieved the predetermined game ending pattern; and awarding a far-miss progressive jackpot to another player whose bingo card has no markings on the predetermined game ending pattern.

30. The dual mode progressive video gaming system of claim 16, wherein the programming instructions further comprises the steps of:

awarding a prize to the player whose bingo card has achieved the predetermined game ending pattern; and awarding a far-miss progressive jackpot to the same player for having a second bingo card that has no markings on the predetermined game ending pattern.

31. A dual mode progressive bingo video gaming system comprising:

a plurality of gaming terminals connected to the dual mode progressive bingo video gaming system;

each gaming terminal comprising a housing, a plurality of input devices supported by the housing, the plurality of input devices including an acceptor configured to receive a wager and establish a credit balance;

a database to record activity on games played on the dual mode progressive bingo video gaming system under Class II gaming rules;

a database to record activity on games played on the dual mode progressive bingo video gaming system under Class III gaming rules;

a shared database for storing progressive information for all games played on the dual mode progressive bingo video gaming system under Class II gaming rules and under Class III gaming rules;

a progressive database to connect to an independent Class II gaming system and an independent Class III gaming system so that a progressive jackpot may be shared among all of the games being played on the dual mode progressive video gaming system, the independent Class II gaming system, and the independent class III gaming system; and a dual mode gaming system comprising:

a switching logic to switch automatically between Class II gaming rules and Class III gaming rules on a play by play basis based on availability of players to create a quorum;

a bingo progressive module for adding bingo-based far-miss progressive jackpots to any game played on the dual mode progressive bingo video gaming system, the bingo progressive module having a ball call system, a quorum builder, and a bingo card distribution system;

a virtual bingo card that is played by the dual mode gaming system when a game is being played under Class III gaming rules;

a processor for executing program instructions and a memory coupled to the processor for storing program instructions, the programming instructions comprising:

receiving at least one play request from at least one player;

continuously monitoring whether another play request is received from at least another player;

determining whether a quorum of players is established within a predetermined period of time;

initiating a multiplayer bingo game under Class II gaming rules when a quorum of players is established within the predetermined period of time;

initiating a single player bingo game under Class III gaming rules when a quorum of players is not established within the pre-determined period of time; and ending one of the multiplayer bingo game and the single player bingo game when a bingo card of a player has achieved a predetermined game ending pattern, wherein the independent Class II gaming system comprises:

an independent Class II database;

an independent ball call system;

an independent bingo card distribution system;

an independent progressive prize distribution system;

at least one independent Class II gaming terminal; and an independent quorum builder, and wherein the at least one independent Class II gaming terminal is connected to the dual mode progressive bingo video gaming system through a bingo progressive plug-in interface and wherein the bingo progressive plug-in interface appears as a side game to a base game being played on the at least one independent Class II gaming terminal.

32. The dual mode progressive video gaming system of claim 31, wherein any play with a quorum of players is logged into the Class II database.

33. The dual mode progressive video gaming system of claim 31, wherein any play with only one player will be logged in the Class III database.

34. The dual mode progressive video gaming system of claim 31, wherein all logging information for games played under Class II gaming rules and games played under Class III gaming rules are stored in the common database.

35. The dual mode progressive video gaming system of claim 31 further comprising a management terminal for generating reports from any of the databases.

36. The dual mode progressive video gaming system of claim 31, wherein the gaming terminals are connected natively to the dual mode progressive bingo video gaming system.

37. The dual mode progressive video gaming system of claim 31, wherein the bingo progressive module may be used as at least one of an outcome generator and a bonusing mechanism for the independent Class II gaming system.

38. The dual mode progressive video gaming system of claim 31, wherein the independent Class III gaming system comprises:

an independent Class III database;

an independent ball call system;

independent bingo card distribution system;

an independent progressive prize distribution system;

at least one independent Class III gaming terminal; and a virtual bingo card that is played by the independent Class III gaming system.

39. The dual mode progressive video gaming system of claim 38, wherein the at least one independent Class III gaming terminal connected to the dual mode progressive bingo video gaming system through a bingo progressive plug-in interface and wherein the bingo progressive plug-in interface appears as a side game to a non-bingo base game being played on the at least one independent Class III gaming terminal.

40. The dual mode progressive video gaming system of claim 38, wherein the bingo progressive module may be used as only a bonusing mechanism for the independent Class III gaming system.

41. The dual mode progressive video gaming system of claim 31, wherein the bingo progressive module may be separated from the dual mode progressive video gaming system and used as a bonusing mechanism with at least one of an independent Class II gaming system and an independent Class III gaming system.

42. The dual mode progressive video gaming system of claim 31, wherein the programming instructions further comprises the steps of:

awarding a prize to the player whose bingo card has achieved the predetermined game ending pattern; and awarding a far-miss progressive jackpot to another player whose bingo card has no markings on the predetermined game ending pattern.

43. The dual mode progressive video gaming system of claim 31, wherein the programming instructions further comprises the steps of:

awarding a prize to the player whose bingo card has achieved the predetermined game ending pattern; and awarding a far-miss progressive jackpot to the same player for having a second bingo card that has no markings on the predetermined game ending pattern.

44. A dual mode bingo video gaming system comprising:

a plurality of gaming terminals connected to the dual mode bingo video gaming system;

each gaming terminal comprising a housing, a plurality of input devices supported by the housing, the plurality of input devices including an acceptor configured to receive a wager and establish a credit balance;

a database to record activity on games played on the dual mode bingo video gaming system under Class II gaming rules;

a database to record activity on games played on the dual mode bingo video gaming system under Class III gaming rules;

a Class II bingo database for storing bingo game information for all games played on the dual mode bingo video gaming system under Class II gaming rules;

a Class III bingo database for storing bingo game information for all games played on the dual mode bingo video gaming system under Class III gaming rules;

a Class II progressive database for storing progressive prize information for all games played on the dual mode bingo video gaming system under Class II gaming rules;

a Class III progressive database for storing progressive prize information for all games played on the dual mode bingo video gaming system under Class III gaming rules; and a dual mode gaming system comprising:

a switching logic to switch automatically between Class II gaming rules and Class III gaming rules on a play by play basis based on availability of players to create a quorum;

a ball call system;

a quorum builder;

a bingo card distribution system;

a virtual bingo card that is played by the dual mode gaming system when a game is being played under Class III gaming rules;

a processor for executing program instructions and a memory coupled to the processor for storing program instructions, the programming instructions comprising:

receiving at least one play request from at least one player;

continuously monitoring whether another play request is received from at least another player;

determining whether a quorum of players is established within a predetermined period of time;

initiating a bingo game under one of Class II gaming rules and Class III gaming rules for the at least one player depending upon whether the quorum of players is established within the predetermined period of time; and ending the bingo game when a bingo card of a player has achieved a predetermined game ending pattern, wherein the Class II progressive database is capable of connecting to an independent Class II gaming system so that progressive prize information may be shared between the games played on the dual mode video gaming system under Class II gaming rules and the games played with the independent Class II gaming system, and wherein the independent Class II gaming system comprises:

an independent Class II database;

an independent ball call system;

an independent bingo card distribution system;

an independent progressive prize distribution system;

at least one independent Class II gaming terminal; and an independent quorum builder, and wherein the at least one independent Class II gaming terminal is connected to the dual mode bingo video gaming system through a bingo progressive plug-in interface and wherein the bingo progressive plug-in interface appears as a side game to a base game being played on the at least one independent Class II gaming terminal.

45. The dual mode bingo video gaming system of claim 44, wherein the switching logic initiates a multiplayer bingo game under Class II gaming rules when a quorum of players is established within the predetermined period of time.

46. The dual mode video gaming system of claim 44, wherein any play with a quorum of players is logged into the Class II database.

47. The dual mode video gaming system of claim 44, wherein the switching logic initiates a single player bingo game under Class III gaming rules when a quorum of players is not established within the pre-determined period of time.

48. The dual mode video gaming system of claim 44, wherein any play with only one player will be logged in the Class III database.

49. The dual mode video gaming system of claim 44, wherein all logging information for games played under Class II gaming rules and games played under Class III gaming rules are stored in the common database.

50. The dual mode video gaming system of claim 44 further comprising a management terminal for generating reports from any of the databases.

51. The dual mode video gaming system of claim 44, wherein the gaming terminals are connected natively to the dual mode bingo video gaming system.

52. The dual mode bingo video gaming system of claim 44 further comprising:

a bingo progressive module for adding bingo-based far-miss progressive jackpots to any game played on the dual mode bingo video gaming system; and a shared database for storing progressive information for all games played on the dual mode bingo video gaming system under Class II gaming rules and under Class III gaming rules.

53. The dual mode video gaming system of claim 44, wherein the bingo progressive module may be used as at least one of an outcome generator and a bonusing mechanism for the independent Class II gaming system.

54. The dual mode video gaming system of claim 44, wherein the independent Class III gaming system comprises:

an independent Class III database;

an independent ball call system;

independent bingo card distribution system;

an independent progressive prize distribution system;

at least one independent Class III gaming terminal; and a virtual bingo card that is played by the independent Class III gaming system.

55. The dual mode video gaming system of claim 54, wherein the at least one independent Class III gaming terminal connected to the dual mode bingo video gaming system through a bingo progressive plug-in interface and wherein the bingo progressive plug-in interface appears as a side game to a non-bingo base game being played on the at least one independent Class III gaming terminal.

56. The dual mode video gaming system of claim 54, wherein the bingo progressive module may be used as only a bonusing mechanism for the independent Class III gaming system.

57. The dual mode video gaming system of claim 52, wherein the bingo progressive module may be used without the dual mode video gaming system as a bonusing mechanism for at least one of an independent Class II gaming system and an independent Class III gaming system.

58. The dual mode progressive video gaming system of claim 44, wherein the programming instructions further comprises the steps of:

awarding a prize to the player whose bingo card has achieved the predetermined game ending pattern; and awarding a far-miss progressive jackpot to another player whose bingo card has no markings on the predetermined game ending pattern.

59. The dual mode progressive video gaming system of claim 44, wherein the programming instructions further comprises the steps of:

awarding a prize to the player whose bingo card has achieved the predetermined game ending pattern; and awarding a far-miss progressive jackpot to the same player for having a second bingo card that has no markings on the predetermined game ending pattern.

60. A dual mode progressive bingo video gaming system comprising:

a plurality of gaming terminals connected to the dual mode progressive bingo video gaming system;

each gaming terminal comprising a housing, a plurality of input devices supported by the housing, the plurality of input devices including an acceptor configured to receive a wager and establish a credit balance;

a database to record activity on games played on the dual mode progressive bingo video gaming system under Class II gaming rules;

a database to record activity on games played on the dual mode progressive bingo video gaming system under Class III gaming rules;

a Class II bingo database for storing bingo game information for all games played on the dual mode progressive bingo video gaming system under Class II gaming rules;

a Class III bingo database for storing bingo game information for all games played on the dual mode progressive bingo video gaming system under Class III gaming rules;

a Class II progressive database for storing progressive prize information for all games played on the dual mode progressive bingo video gaming system under Class II gaming rules;

a Class III progressive database for storing progressive prize information for all games played on the dual mode progressive bingo video gaming system under Class III gaming rules; and a dual mode gaming system comprising:

a switching logic to switch automatically between Class II gaming rules and Class III gaming rules on a play by play basis based on availability of players to create a quorum;

a bingo progressive module for adding bingo-based far-miss progressive jackpots to any game played on the dual mode progressive bingo video gaming system, the bingo progressive module having a ball call system, a quorum builder, and a bingo card distribution system;

a virtual bingo card that is played by the dual mode gaming system when a game is being played under Class III gaming rules;

a processor for executing program instructions and a memory coupled to the processor for storing program instructions, the programming instructions comprising:

receiving at least one play request from at least one player;

continuously monitoring whether another play request is received from at least another player;

determining whether a quorum of players is established within a predetermined period of time;

initiating a bingo game under Class II gaming rules for the at least one player when a quorum of players is established within the predetermined period of time;

initiating a single player bingo game under Class III gaming rules for the at least one player depending upon whether the when a quorum of players is not established within the predetermined period of time; and ending the bingo game when a bingo card of a player has achieved a predetermined game ending pattern, wherein the Class II progressive database is capable of connecting to an independent Class II gaming system so that progressive prize information may be shared between the games played on the dual mode progressive video gaming system under Class II gaming rules and the games played with the independent Class II gaming system, and wherein the independent Class II gaming system comprises:

an independent Class II database;

an independent ball call system;

an independent bingo card distribution system;

an independent progressive prize distribution system;

at least one independent Class II gaming terminal; and an independent quorum builder, and wherein the at least one independent Class II gaming terminal is connected to the dual mode progressive bingo video gaming system through a bingo progressive plug-in interface and wherein the bingo progressive plug-in interface appears as a side game to a base game being played on the at least one independent Class II gaming terminal.

61. The dual mode progressive bingo video gaming system of claim 60, wherein the switching logic initiates a multi-player bingo game under Class II gaming rules when a quorum of players is established within the predetermined period of time.

62. The dual mode progressive video gaming system of claim 60, wherein any play with a quorum of players is logged into the Class II database.

63. The dual mode progressive video gaming system of claim 60, wherein the switching logic initiates a single player bingo game under Class III gaming rules when a quorum of players is not established within the pre-determined period of time.

64. The dual mode progressive video gaming system of claim 60, wherein any play with only one player will be logged in the Class III database.

65. The dual mode progressive video gaming system of claim 60, wherein all logging information for games played under Class II gaming rules and games played under Class III gaming rules are stored in the common database.

66. The dual mode progressive video gaming system of claim 60 further comprising a management terminal for generating reports from any of the databases.

67. The dual mode progressive video gaming system of claim 60, wherein the gaming terminals are connected natively to the dual mode progressive bingo video gaming system.

68. A dual mode progressive bingo video gaming system comprising:

a plurality of gaming terminals connected to the dual mode progressive bingo video gaming system;

each gaming terminal comprising a housing, a plurality of input devices supported by the housing, the plurality of input devices including an acceptor configured to receive a wager and establish a credit balance;

a database to record activity on games played on the dual mode progressive bingo video gaming system under Class II gaming rules;

a database to record activity on games played on the dual mode progressive bingo video gaming system under Class III gaming rules;

a Class II bingo database for storing bingo game information for all games played on the dual mode progressive bingo video gaming system under Class II gaming rules;

a Class III bingo database for storing bingo game information for all games played on the dual mode progressive bingo video gaming system under Class III gaming rules;

a Class II progressive database for storing progressive prize information for all games played on the dual mode progressive bingo video gaming system under Class II gaming rules;

a Class III progressive database for storing progressive prize information for all games played on the dual mode progressive bingo video gaming system under Class III gaming rules; and a dual mode gaming system comprising:

a switching logic to switch automatically between Class II gaming rules and Class III gaming rules on a play by play basis based on availability of players to create a quorum;

a bingo progressive module for adding bingo-based far-miss progressive jackpots to any game played on the dual mode progressive bingo video gaming system, the bingo progressive module having a ball call system, a quorum builder, and a bingo card distribution system;

a virtual bingo card that is played by the dual mode gaming system when a game is being played under Class III gaming rules;

a processor for executing program instructions and a memory coupled to the processor for storing program instructions, the programming instructions comprising:

receiving at least one play request from at least one player;

continuously monitoring whether another play request is received from at least another player;

determining whether a quorum of players is established within a predetermined period of time;

initiating a bingo game under one of Class II gaming rules and Class III gaming rules for the at least one player depending upon whether the quorum of players is established within the predetermined period of time; and ending the bingo game when a bingo card of a player has achieved a predetermined game ending pattern, wherein the Class II progressive database is capable of connecting to an independent Class II gaming system so that progressive prize information may be shared between the games played on the dual mode progressive video gaming system under Class II gaming rules and the games played with the independent Class II gaming system, and wherein the independent Class II gaming system comprises:

an independent Class II database;

an independent ball call system;

an independent bingo card distribution system;

an independent progressive prize distribution system;

at least one independent Class II gaming terminal; and an independent quorum builder, and wherein the at least one independent Class II gaming terminal is connected to the dual mode progressive bingo video gaming system through a bingo progressive plug-in interface and wherein the bingo progressive plug-in interface appears as a side game to a base game being played on the at least one independent Class II gaming terminal.

69. The dual mode progressive video gaming system of claim 68 wherein the Class III progressive database is capable of connecting to an independent Class III gaming system so that progressive prize information may be shared between the games played on the dual mode progressive video gaming system under Class III gaming rules and the games played with the independent Class III gaming system.

70. The dual mode progressive video gaming system of claim 68, wherein the bingo progressive module may be used as at least one of an outcome generator and a bonusing mechanism for the independent Class II gaming system.

71. The dual mode progressive video gaming system of claim 69, wherein the independent Class III gaming system comprises:

an independent Class III database;

an independent ball call system;

independent bingo card distribution system;

an independent progressive prize distribution system;

at least one independent Class III gaming terminal; and a virtual bingo card that is played by the independent Class III gaming system.

72. The dual mode progressive video gaming system of claim 71, wherein the at least one independent Class III gaming terminal connected to the dual mode progressive bingo video gaming system through a bingo progressive plug-in interface and wherein the bingo progressive plug-in interface appears as a side game to a non-bingo base game being played on the at least one independent Class III gaming terminal.

73. The dual mode progressive video gaming system of claim 71, wherein the bingo progressive module may be used as only a bonusing mechanism for the independent Class III gaming system.

* * * * *